US010748698B2

(12) United States Patent
Okura et al.

(10) Patent No.: US 10,748,698 B2
(45) Date of Patent: Aug. 18, 2020

(54) ELECTRONIC COMPONENT

(71) Applicant: Murata Manufacturing Co., Ltd., Kyoto (JP)

(72) Inventors: Ryo Okura, Nagaokakyo (JP); Mizuho Katsuta, Nagaokakyo (JP); Kosuke Ishida, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 17 days.

(21) Appl. No.: 15/673,988

(22) Filed: Aug. 10, 2017

(65) Prior Publication Data

US 2018/0061554 A1 Mar. 1, 2018

(30) Foreign Application Priority Data

Sep. 1, 2016 (JP) ..... 2016-170903

(51) Int. Cl.
*H01F 27/32* (2006.01)
*H01F 27/28* (2006.01)
*H01F 27/29* (2006.01)

(52) U.S. Cl.
CPC ..... *H01F 27/2804* (2013.01); *H01F 27/292* (2013.01); *H01F 27/323* (2013.01); *H01F 2027/2809* (2013.01)

(58) Field of Classification Search
CPC .. H01F 5/06; H01F 17/0013; H01F 2017/004; H01F 2017/0073;
(Continued)

(56) References Cited

U.S. PATENT DOCUMENTS 6,356,181 B1 * 3/2002 Kitamura ..... H01F 17/0013 336/200
10,038,421 B2 7/2018 Kameya
(Continued)

FOREIGN PATENT DOCUMENTS

JP 2000-030945 A 1/2000
JP 4209851 B2 1/2009
(Continued)

OTHER PUBLICATIONS

An Office Action; "Notification of Reasons for Refusal," Mailed by the Japanese Patent Office dated Feb. 5, 2019, which corresponds to Japanese Patent Application No. 2016-170903 and is related to U.S. Appl. No. 15/673,988; with English language translation.

*Primary Examiner* — Mang Tin Bik Lian
(74) *Attorney, Agent, or Firm* — Studebaker & Brackett PC

(57) ABSTRACT

An electronic component having a main body includes a plurality of insulator layers laminated in a lamination direction. A primary coil is disposed in the main body and includes one or more primary coil conductor layers. A secondary coil is disposed in the main body and includes one or more secondary coil conductor layers. A tertiary coil is disposed in the main body and includes one or more tertiary coil conductor layers. The plurality of insulator layers includes a first insulator layer including a portion interposed between the primary coil conductor layer and the secondary coil conductor layer, a second insulator layer including a portion interposed between the secondary coil conductor layer and the tertiary coil conductor layer, and a third insulator layer including a portion interposed between the tertiary coil conductor layer and the primary coil conductor layer.

12 Claims, 15 Drawing Sheets

(58) Field of Classification Search
CPC ..... H01F 2017/0093; H01F 27/2804; H01F 27/323; H01F 27/292; H01F 27/29; H01F 2027/2809
USPC ..... 336/200, 223, 192, 170, 147, 205
See application file for complete search history.

(56) References Cited

U.S. PATENT DOCUMENTS

| | | | | |
|---|---|---|---|---|
| 2007/0030659 | A1* | 2/2007 | Suzuki | H01F 17/0013 361/793 |
| 2009/0278627 | A1* | 11/2009 | Umemoto | C04B 35/18 333/185 |
| 2012/0119867 | A1* | 5/2012 | Odahara | H01F 17/0013 336/200 |
| 2013/0076474 | A1 | 3/2013 | Chang et al. | |
| 2014/0368307 | A1* | 12/2014 | Kato | H01F 17/0013 336/200 |
| 2015/0270055 | A1* | 9/2015 | Nakamura | H01F 5/00 336/200 |
| 2016/0189851 | A1* | 6/2016 | Lee | H01F 27/2804 174/260 |
| 2016/0372254 | A1* | 12/2016 | Harada | H01F 27/2804 |
| 2017/0092417 | A1 | 3/2017 | Kameya | |

FOREIGN PATENT DOCUMENTS

| | | | |
|---|---|---|---|
| WO | 2015181883 | A1 | 12/2015 |
| WO | 2016/132410 | A1 | 8/2016 |

* cited by examiner

ELECTRONIC COMPONENT

CROSS REFERENCE TO RELATED APPLICATIONS

This application claims benefit of priority to Japanese Patent Application 2016-170903 filed Sep. 1, 2016, the entire content of which is incorporated herein by reference.

TECHNICAL FIELD

The present disclosure relates to an electronic component including a common mode filter.

BACKGROUND

For example, a common mode choke coil described in Japanese Patent No. 4209851 is known as a disclosure related to a conventional common mode filter. FIG. 12 is a cross-sectional structural view of a common mode choke coil 510 described in Japanese Patent No. 4209851.

The common mode choke coil 510 includes a main body 512, and coils 514, 516, 518. The coils 514, 516, 518 form a spiral shape spiraling clockwise from the outer circumferential side to the inner circumferential side when viewed from the upper side of the plane of FIG. 12 and overlap with each other. The coil 518 is interposed between the coil 514 and the coil 516 on both the upper and lower sides. In this common mode choke coil 510, a high-frequency signal is transmitted to the coils 514, 516, and a ground potential is connected to the coil 518.

SUMMARY

Problem to be Solved by the Disclosure

The inventor of the present application studied an electronic component including three coils exemplified by the common mode choke coil 510 described in Japanese Patent No. 4209851 in terms of, for example, transmitting a high-frequency signal to each of the coils 514, 516, 518 to remove a common mode noise from the high-frequency signal and a problem in this case.

First, in the common mode choke coil 510, a difference in differential impedance is generated between the coils 514, 516, 518 as described below. As shown in FIG. 12, the coil 514 and the coil 518 face each other in proximity and the coil 516 and the coil 518 face each other in proximity, while the coil 514 and the coil 516 are significantly distant from each other because of the presence of the coil 518 between the coil 514 and the coil 516. Therefore, the capacitance generated between the coil 514 and the coil 516 becomes smaller than the capacitance generated between the coil 514 and the coil 518 and the capacitance generated between the coil 516 and the coil 518. As a result, the differential impedance between the coil 514 and the coil 516 becomes larger than the differential impedance between the coil 514 and the coil 518 and the differential impedance between the coil 516 and the coil 518.

Therefore, a study was made to improve the configuration of the common mode choke coil 510 so as to bring the capacitance between the coil 514 and the coil 516 closer to the capacity between the coil 514 and the coil 518 and the capacitance between the coil 516 and the coil 518 without disturbing the waveform of the transmitted high-frequency signal. However, the inventor of the present application conceived that it is not necessarily advantageous to simply match these capacities, as described below.

In the case described above, the common mode choke coil 510 is mounted on a circuit board described below. FIG. 13 is a plane view of a circuit board 600 on which the common mode choke coil 510 is mounted. FIG. 14 is a cross-sectional structural view taken along 14-14 of the circuit board 600 on which the common mode choke coil 510 is mounted. The circuit board 600 includes a board main body 602, signal lines 604, 606, 608, and a ground conductor layer 610. The substrate main body 602 is a plate-shaped insulating substrate. The signal lines 604, 606, 608 are disposed on an upper principal surface of the substrate main body 602 and are linear conductor layers extending in parallel with each other. The ground conductor layer 610 is disposed on a lower principal surface of the substrate main body 602 and overlaps with the signal lines 604, 606, 608. As a result, the signal lines 604, 606, 608, and the ground conductor layer 610 form a microstrip line structure.

When the common mode choke coil 510 is mounted on the circuit board 600 as described above, positions of external electrodes (terminal electrodes) thereof allow the signal line 604 to connect with the coil 514, the signal line 606 to connect with the coil 518, and the signal line 608 to connect with the coil 516. In this case, unless matching is achieved in the connection relationship described above for the three differential impedances between the coils 514, 516, 518 and the three differential impedances between the signal lines 604, 606, 608, a high-frequency signal is reflected between the circuit board 600 and the common mode choke coil 510.

In the circuit board 600, a difference occurs in the differential impedance between the signal lines 604, 606, 608 as described below. As shown in FIGS. 13 and 14, the signal line 604 and the signal line 606 are adjacent to each other, and the signal line 606 and the signal line 608 are adjacent to each other. On the other hand, since the signal line 606 is present between the signal line 604 and the signal line 608, the signal line 604 and the signal line 608 are significantly separated from each other. Therefore, the capacitance generated between the signal line 604 and the signal line 608 becomes smaller than the capacitance generated between the signal line 604 and the signal line 606 and the capacitance generated between the signal line 606 and the signal line 608. Therefore, the differential impedance between the signal line 604 and the signal line 608 becomes larger than the differential impedance between the signal line 604 and the signal line 606 and the differential impedance between the signal line 606 and the signal line 608.

Therefore, to improve the common mode choke coil 510, it is preferable that differential impedances between coils be set in consideration of not only a mutual difference in differential impedance between the coils but also matching with a difference in differential impedance generated between signal lines of the circuit board as described above. From the above, the inventor of the present application conceived an electronic component capable of adjusting a difference in differential impedance between coils.

It is therefore a problem to be solved by the present disclosure to provide an electronic component capable of adjusting a difference in differential impedance between coils in an electronic component including a common mode filter made up of three coils.

Solutions to the Problems

To solve the problem, an electronic component according to an embodiment of the present disclosure comprises a main body including a plurality of insulator layers laminated in a lamination direction;

a primary coil disposed in the main body and including one or more primary coil conductor layers;

a secondary coil disposed in the main body and including one or more secondary coil conductor layers; and a tertiary coil disposed in the main body and including one or more tertiary coil conductor layers, wherein the plurality of insulator layers includes a first insulator layer including a portion interposed between the primary coil conductor layer and the secondary coil conductor layer, a second insulator layer including a portion interposed between the secondary coil conductor layer and the tertiary coil conductor layer, and a third insulator layer including a portion interposed between the tertiary coil conductor layer and the primary coil conductor layer, and wherein the electronic component has an insulator layer different in permittivity from the other insulator layers among the first insulator layer, the second insulator layer, and the third insulator layer.

According to the electronic component described above, the parasitic capacitance generated between the facing coil conductor layers can be changed. Therefore, a difference in differential impedance between the coils can be adjusted.

The electronic component of an embodiment further comprises a first external electrode electrically connected to one end of the primary coil, a second external electrode electrically connected to one end of the secondary coil, and a third external electrode electrically connected to one end of the tertiary coil, wherein the first external electrode, the second external electrode, and the third external electrode are arranged in this order along a predetermined direction orthogonal to the lamination direction on one surface of the main body, and wherein the permittivity of the third insulator layer is different from the permittivity of the first insulator layer and the permittivity of the second insulator layer.

According to the electronic component described above, the differential impedance can be adjusted between the primary coil and the tertiary coil corresponding to between signal lines having a differential impedance different from those between the other signal lines on a circuit board.

The electronic component of an embodiment further comprises a fourth external electrode electrically connected to the other end of the primary coil, a fifth external electrode electrically connected to the other end of the secondary coil, and a sixth external electrode electrically connected to the other end of the tertiary coil, wherein the fourth external electrode, the fifth external electrode, and the sixth external electrode are arranged in this order along the predetermined direction on one surface of the main body, and wherein the primary coil, the secondary coil, and the tertiary coil all have the same circumferential direction from the first external electrode to the fourth external electrode, from the second external electrode to the fifth external electrode, and from the third external electrode to the sixth external electrode, respectively.

According to the electronic component described above, for example, when a high-frequency signal is transmitted by using the first to third external electrodes as input terminals and the fourth to sixth external electrodes as output terminals, the primary to tertiary coils are magnetically positively coupled and this allows the electronic component to function as a common mode filter. The same applies to the case of using the first to third external electrodes as output terminals and the fourth to sixth external electrodes as input terminals.

In the electronic component of an embodiment, the one or more primary coil conductor layers include a natural number n of series primary coil conductor layers and one parallel primary coil conductor layer, wherein the one or more secondary coil conductor layers include n secondary coil conductor layers, wherein the one or more tertiary coil conductor layers include n tertiary coil conductor layers, wherein the parallel primary coil conductor layer is electrically connected in parallel to a predetermined series primary coil conductor layer of the n series primary coil conductor layers, and wherein the third insulator layer includes a fourth insulator layer including a portion interposed between the tertiary coil conductor layer and the parallel primary coil conductor layer.

According to the electronic component described above, while suppressing the influence on the electrical characteristics of the primary coil, the differential impedance between the primary coil and the tertiary coil can be brought closer to the differential impedance between the primary coil and the secondary coil and the differential impedance between the secondary coil and the tertiary coil.

In the electronic component of an embodiment, the electronic component has n coil conductor layer groups arranged from one side to the other side in the lamination direction, wherein the coil conductor layer groups each have the series primary coil conductor layer, the secondary coil conductor layer, and the tertiary coil conductor layer arranged one by one in this order from one side to the other side in the lamination direction, and wherein the parallel primary coil conductor layer is disposed on the other side in the laminated direction with respect to the predetermined tertiary coil conductor layer disposed on the farthest other side in the lamination direction.

According to the electronic component described above, the facing portions of the primary coil and the secondary coil, the facing portions of the secondary coil and the tertiary coil, and the facing portions of the tertiary coil and the primary coil appear equally in order, so that the difference in differential impedance can easily be adjusted between the coils.

In the electronic component of an embodiment, an interval between the parallel primary coil conductor layer and the predetermined tertiary coil conductor layer in the lamination direction is larger than intervals between the coil conductor layers adjacent to each other in the lamination direction in the n coil conductor layer groups.

According to the electronic component described above, the capacitance generated between the tertiary coil conductor layer and the parallel primary coil conductor layer can be made smaller than the capacitance generated between the series primary coil conductor layer and the capacitance generated between the secondary coil conductor layer and the tertiary coil conductor layer, and the difference in differential impedance between the coils can be adjusted.

In the electronic component of an embodiment, the coil conductor layers adjacent to each other in the lamination direction have uniform intervals in the n coil conductor layer groups.

According to the electronic component described above, the lamination conditions can be made uniform in the n coil conductor layer groups, so that the reliability of the electronic component is improved, and the manufacturing process can be streamlined.

In the electronic component of an embodiment, the parallel primary coil conductor layer and the predetermined series primary coil conductor layer have the same shape when viewed in the lamination direction.

According to the electronic component described above, since the lengths of the current paths are equal between the predetermined series primary coil conductor layer and the parallel primary coil conductor layer electrically connected in parallel, the influence on the electrical characteristics of the primary coil can be reduced.

In the electronic component of an embodiment, the primary coil, the secondary coil, and the tertiary coil have lengths of current paths identical to each other, wherein when the (n−1) series primary coil conductor layers other than the predetermined series primary coil conductor layer are defined as the other series primary coil conductor layers, the other series primary coil conductor layers all have the same cross-sectional area, and wherein the sum of the cross-sectional area of the predetermined series primary coil conductor layer and the cross-sectional area of the parallel primary coil conductor layer are the same as the cross-sectional area of the other series primary coil conductor layers.

According to the electronic component described above, the combined electrical resistance of the predetermined series primary coil conductor layer and the parallel primary coil conductor layer can be brought closer to the electrical resistance of the other primary coil conductor layers.

In the electronic component of an embodiment, the cross-sectional area of the predetermined series primary coil conductor layer and the cross-sectional area of the parallel primary coil conductor layer are the same.

According to the electronic component described above, the electrical resistances of the predetermined series primary coil conductor layer and the parallel primary coil conductor layer can be brought closer to each other. Since the lamination conditions of the predetermined series primary coil conductor layer and the parallel primary coil conductor layer can be the same, a reduction in concentration of stress due to a difference in thickness can be achieved, along with the improvement in reliability and the streamlined process.

In the electronic component of an embodiment, the n secondary coil conductor layers and the n tertiary coil conductor layers all have the same cross-sectional area, and wherein the sum of the cross-sectional area of the predetermined series primary coil conductor layer and the cross-sectional area of the parallel primary coil conductor layer is the same as the cross-sectional area of the secondary coil conductor layer and the cross-sectional area of the tertiary coil conductor layer.

According to the electronic component described above, the combined electrical resistance of the electrical resistance value of the predetermined series primary coil conductor layer and the electrical resistance value of the parallel primary coil conductor layer can be brought closer to the electrical resistance of the secondary coil conductor layer and the tertiary coil conductor layer. Since the lamination conditions of the secondary coil conductor layer and the tertiary coil conductor layer can be the same, a reduction in concentration of stress due to a difference in thickness can be achieved, along with the improvement in reliability and the streamlined process.

In the electronic component of an embodiment, a volume of conductor constituting the primary coil, a volume of conductor constituting the secondary coil, and a volume of conductor constituting the tertiary coil are the same as each other.

According to the electronic component described above, the electrical characteristics of the primary coil, the secondary coil, and the tertiary coil can be brought closer to each other.

Effect of the Disclosure

According to the electronic component of an embodiment of the present disclosure, a difference in differential impedance between coils can be adjusted in the electronic component including a common mode filter made up of three coils.

DETAILED DESCRIPTION

Embodiments of the present disclosure will now be described in detail with reference to shown embodiments.

First Embodiment (Configuration of Electronic Component)

Figure 1:
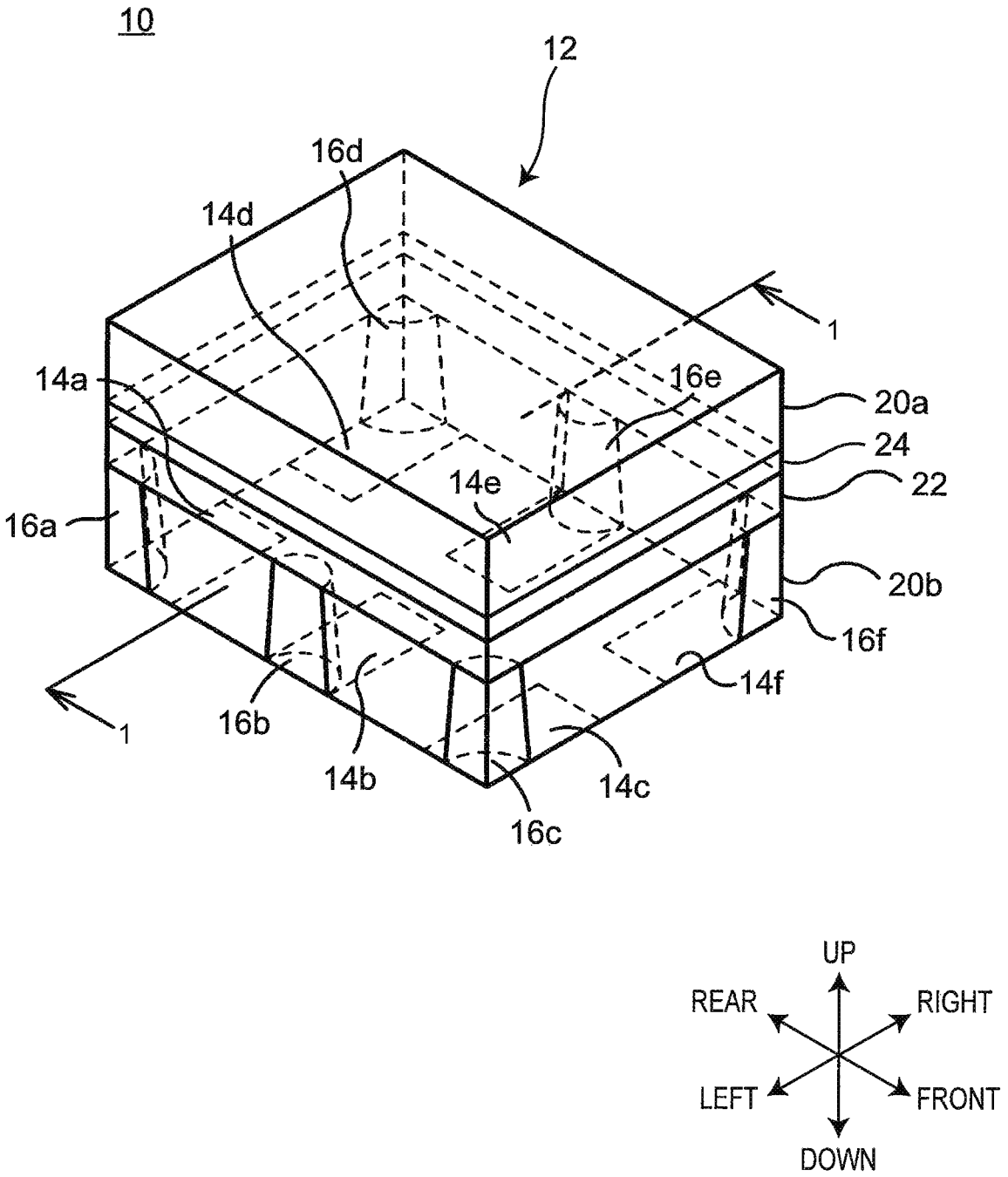
FIG. 1 is a perspective view of an exterior appearance of an electronic component 10 according to an embodiment of the present disclosure.
Figure 2:
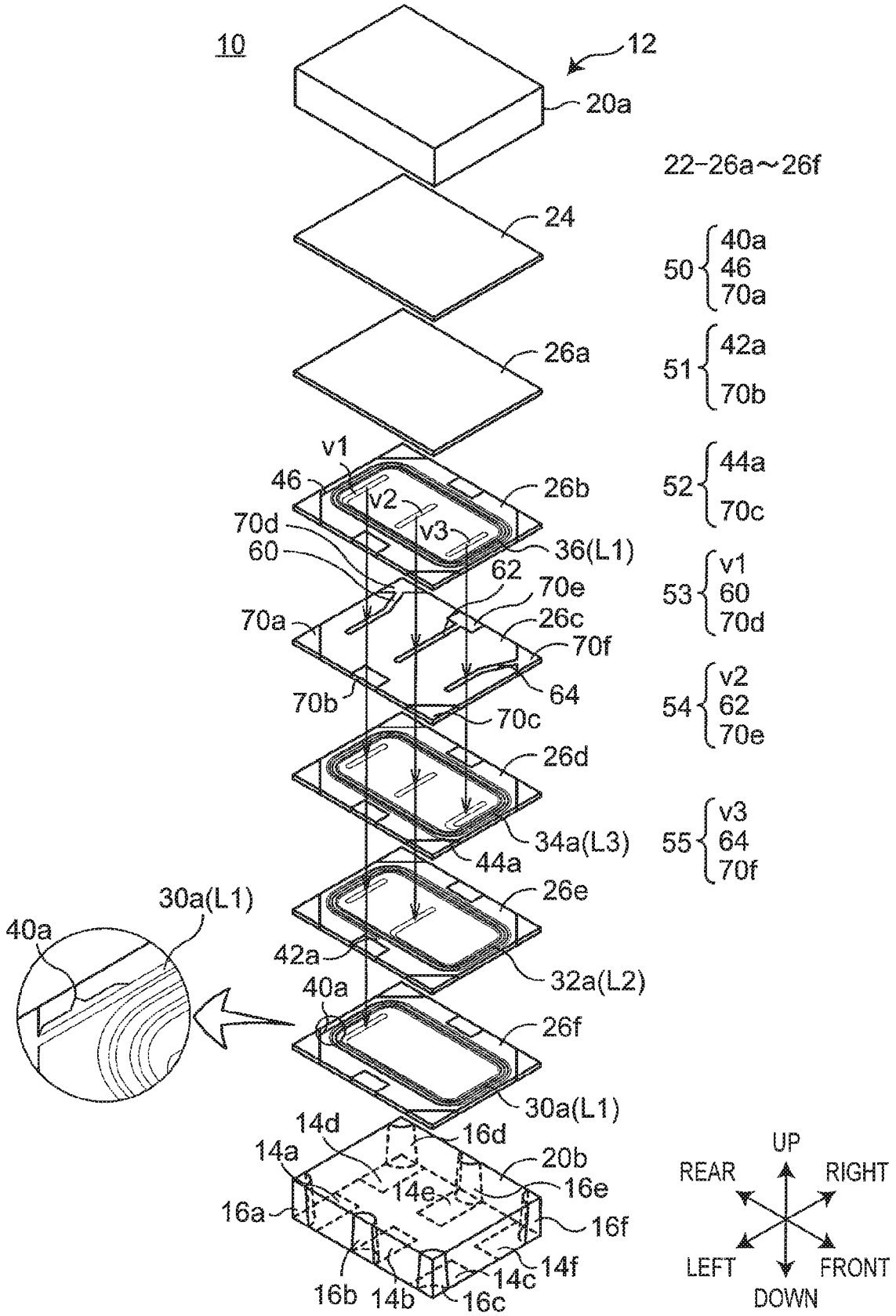
FIG. 2 is an exploded perspective view of the electronic component 10 of FIG. 1.
Figure 3A:
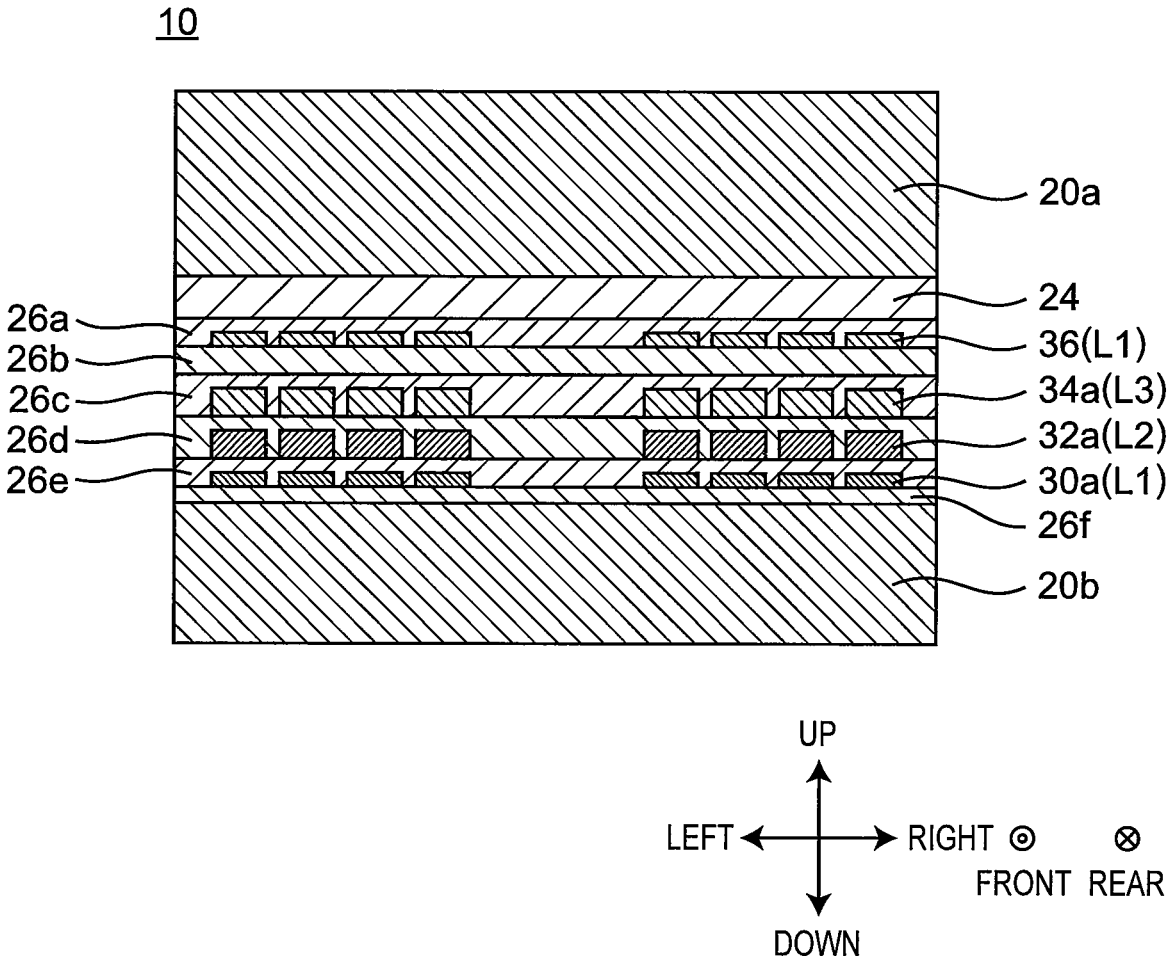
FIG. 3A is a cross-sectional view taken along a line 1-1 of FIG. 1.
Figure 3B:
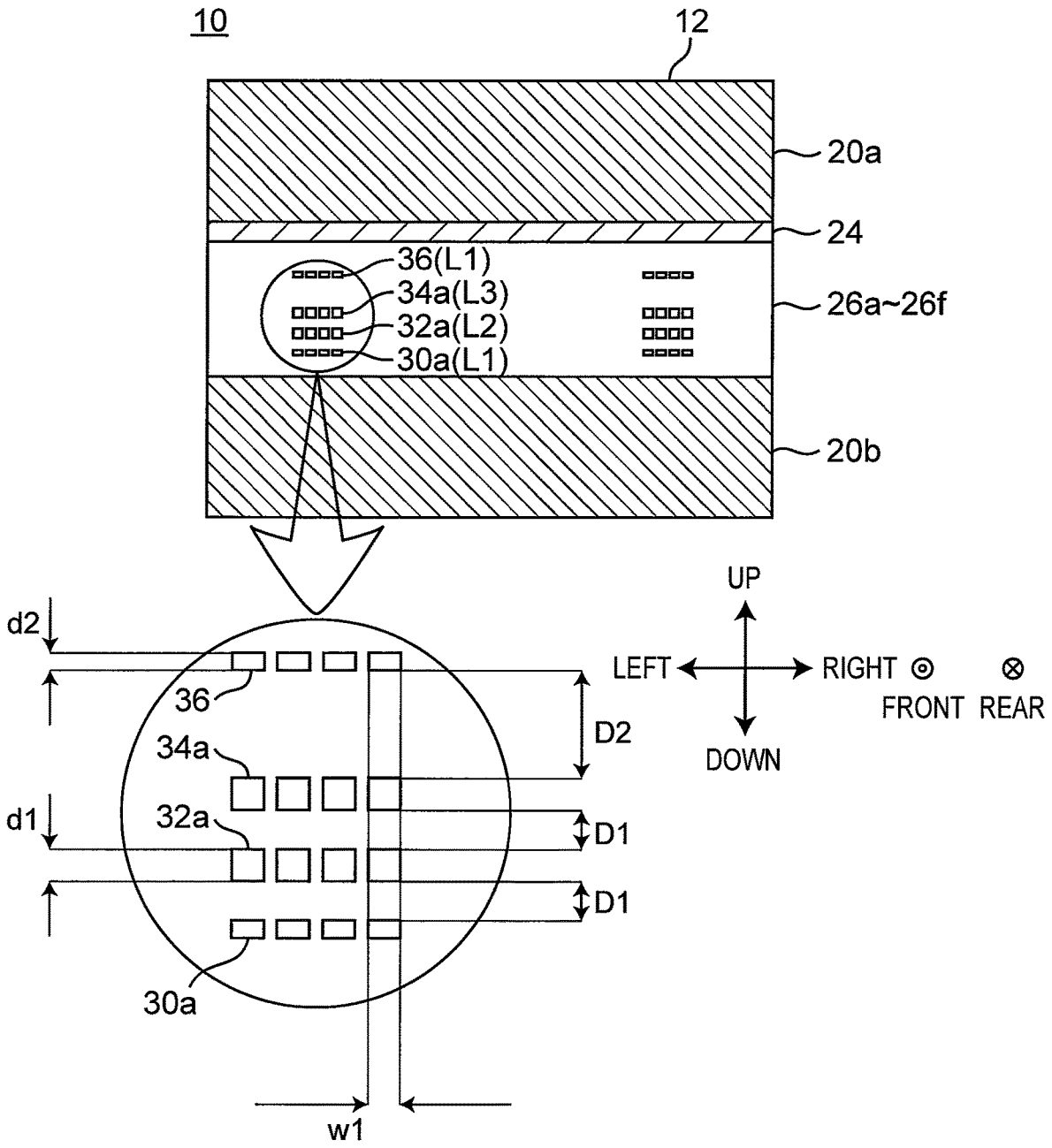
FIG. 3B is a schematic diagram of FIG. 3A.

FIG. 1 is a perspective view of an exterior appearance of an electronic component 10 according to an embodiment of the present disclosure; FIG. 2 is an exploded perspective view of the electronic component 10 of FIG. 1; FIG. 3A is a cross-sectional view taken along a line 1-1 of FIG. 1; and FIG. 3B is a schematic diagram of FIG. 3A. In the following description, the lamination direction of the electronic component 10 is defined as an up-down direction and, when viewed in the up-down direction, a direction of extension of a long side is defined as a front-rear direction, and a direction of extension of a short side is defined as a left-right direction. The up-down direction, the front-rear direction, and the left-right direction are orthogonal to each other. For the purpose of description, up/down and left/right are defined based on FIG. 3A and the near side and the far side on the plane of FIG. 3A are defined as the front side and the rear side, respectively; however, these directions do not need to be coincident with up/down, left/right, and front/rear in an actual usage form of the electronic component 10. It is noted that the lamination direction is a direction in which insulator layers described later are laminated.

As shown in FIGS. 1 to 3B, the electronic component 10 includes a main body 12, external electrodes 14*a* to 14*f*, connecting parts 16*a* to 16*f*, lead-out parts 50 to 55, a primary coil L1, a secondary coil L2, and a tertiary coil L3.

As shown in FIGS. 1 and 2, the main body 12 forms a rectangular parallelepiped shape and includes magnetic material substrates 20*a*, 20*b*, a laminated body 22, and a magnetic material layer 24. The magnetic material substrate 20*a*, the magnetic material layer 24, the laminated body 22, and the magnetic material substrate 20*b* are laminated in this order from the upper side to the lower side.

The magnetic material substrates 20*a*, 20*b* are plate-shaped members forming a rectangular shape when viewed from the upper side. Each of the four corners of the magnetic material substrate 20*b* is provided with a cutout forming a fan shape having a central angle of 90 degrees when viewed from the upper side. Each of the centers of the two long sides of the magnetic material substrate 20*b* has a cutout forming a semicircle when viewed from the upper side. The six cutouts extend in the up-down direction on the side surfaces of the magnetic material substrate 20*b* from the upper principal surface of the magnetic material substrate 20*b* to reach the lower principal surface.

The magnetic material substrates 20*a*, 20*b* are made of sintered ferrite ceramics, for example. The magnetic material substrates 20*a*, 20*b* may be made of a cured magnetic paste containing a magnetic material powder such as a ferrite calcined powder or a metal powder in a binder made of a resin etc., and may be fabricated by applying the magnetic paste onto a ceramic substrate of alumina etc.

The external electrodes 14*a* to 14*f* are disposed on the lower principal surface of the magnetic material substrate 20*b* and forms a rectangular shape. More specifically, the external electrodes 14*a*, 14*b*, 14*c* are disposed on corners located at the left rear, left center, and left front, respectively, of the lower principal surface of the magnetic material substrate 20*b* and are arranged in this order from the rear side to the front side. The external electrodes 14*d*, 14*e*, 14*f* are disposed on the corners located at the right rear, right center, and right front, respectively, of the lower principal surface of the magnetic material substrate 20*b* and are arranged in this order from the rear side to the front side. The external electrodes 14*a* to 14*f* are fabricated by forming a film of a material mainly composed of, for example, Cu, Ag, Au, Ni, Cu, or Ti by a sputtering method. The external electrodes 14*a* to 14*f* may be fabricated by printing and baking a paste containing the material, or may be fabricated by forming a film of the material by vapor deposition or a plating method. Furthermore, the external electrodes 14*a* to 14*f* may be formed by laminating multiple layers of different materials.

The connecting parts 16*a* to 16*f* are disposed in the six cutouts of the magnetic material substrate 20*b*. The connecting parts 16*a* to 16*f* are disposed in the cutouts located at the left rear, left center, left front, right rear, right center, and right front, respectively, of the magnetic material substrate 20*b* and are connected at the lower ends thereof to the external electrodes 14*a* to 14*f*, respectively. The connecting parts 16*a* to 16*f* are fabricated by the same material/method as the external electrodes 14*a* to 14*f*, for example. The external electrodes 14*a* to 14*f* and the connecting parts 16*a* to 16*f* may be separate members or may be integrated.

The laminated body 22 includes insulator layers 26*a* to 26*f* (an example of a plurality of insulator layers) laminated on the upper principal surface of the magnetic material substrate 20*b* and forms a rectangular shape when viewed from the upper side. The insulator layers 26*a* to 26*f* are laminated in this order from the upper side to the lower side and the principal surfaces thereof have substantially the same outer shape as the upper principal surface of the magnetic material substrate 20*b*. When viewed from the upper side, the insulator layers 26*b* to 26*f* are each cut out at the four corners and the centers of the two long sides.

The insulator layers 26*a* to 26*f* are made of, for example, an insulating resin such as acrylic resin, silicone resin, fluorine resin, polyimide resin, polyolefin resin, alicyclic olefin resin, epoxy resin, and benzocyclobutene, an insulating inorganic material such as glass ceramics, silicon nitride, silicon dioxide $SiO_2$ (silica), etc. From the viewpoint of setting of a permittivity described later, a known material may be used regardless of the material described above.

The magnetic material layer 24 is disposed between the laminated body 22 and the magnetic material substrate 20*a* to planarize the upper principal surface of the laminated body 22 and join the laminated body 22 and the magnetic material substrate 20*a*. The magnetic material layer 24 is made of the magnetic paste described above, for example.

The primary coil L1 is disposed in the main body 12 and includes a primary coil conductor layers 30*a*, 36. The primary coil conductor layers 30*a*, 36 are disposed on the upper principal surfaces of the insulator layers 26*f*, 26*b*, respectively and form a spiral shape spiraling clockwise from the outer circumferential side to the inner circumferential side when viewed from the upper side. In this embodiment, the primary coil conductor layers 30*a*, 36 have a length of about four turns. The centers of the primary coil conductor layers 30*a*, 36 are substantially coincident with the center (intersection of diagonals) of the electronic component 10 when viewed from the upper side. The primary coil conductor layers 30*a*, 36 form the same shape and are electrically connected in parallel. Therefore, in this embodiment, the primary coil conductor layer 36 corresponds to a parallel primary coil conductor layer, and the primary coil conductor layer 30*a* corresponds to a predetermined series primary coil conductor layer. However, the correspondence relationship may be reversed, so that the primary coil conductor layer 36 and the primary coil conductor layer 30*a* may be the series primary coil conductor layer and the parallel primary coil conductor layer, respectively.

The lead-out part 50 connects one end of the primary coil L1 (outer circumferential end portions of the primary coil conductor layers 30*a*, 36) and the external electrode 14*a*. The lead-out part 50 includes lead-out conductor layers 40*a*, 46 and a connecting conductor 70*a*. The connecting conductor 70*a* is a triangular prism-shaped conductor disposed in the corner located at the left rear of the insulator layers 26*b* to 26*f*. Although the connecting conductor 70*a* is shown divided into five pieces in FIG. 2 for easy understanding, the connecting conductor 70*a* may be a divided member or an integrated member. Similarly to the connecting conductor 70*a*, connecting conductors 70*b* to 70*f* are each shown divided into five pieces. The connecting conductor 70*a* extends in the up-down direction from the upper principal surface of the insulator layer 26*b* to the lower principal surface of the insulator layer 26*f* and is connected at the lower end thereof to the connecting part 16*a*.

The lead-out conductor layers 40*a*, 46 are respectively disposed on the upper principal surfaces of the insulator layers 26*f*, 26*b* and connected to outer circumferential end portions of the primary coil conductor layers 30*a*, 36 and are connected to the connecting conductor 70*a*. The lead-out conductor layers 40*a*, 46 do not form a spiral shape when viewed from the upper side, and extend from the outer circumferential end portions of the primary coil conductor layers 30*a*, 36 toward the left side. As shown in the enlarged view of FIG. 2, the boundaries between the primary coil conductor layers 30*a*, 36 and the lead-out conductor layers 40*a*, 46 are positions at which the lead-out conductor layers 40*a*, 46 deviate from the loci of the spiral shapes formed by the primary coil conductor layers 30*a*, 36. As a result, the one end of the primary coil L1 (the outer circumferential end portions of the primary coil conductor layers 30*a*, 36) and the external electrode 14*a* are electrically connected through the lead-out part 50 (the lead-out conductor layers 40*a*, 46 and the connecting conductor 70*a*) and the connecting part 16*a*.

The lead-out part 53 connects the other end of the primary coil L1 (inner circumferential end portions of the primary coil conductor layers 30*a*, 36) and the external electrode 14*d*. The lead-out part 53 includes an interlayer connecting conductor v1, a lead-out conductor layer 60, and the connecting conductor 70*d*. The connecting conductor 70*d* is a triangular prism-shaped conductor disposed in the corner located at the right rear of the insulator layers 26*b* to 26*f*. The connecting conductor 70*d* extends in the up-down direction from the upper principal surface of the insulator layer 26*b* to the lower principal surface of the insulator layer 26*f* and is connected at the lower end thereof to the connecting part 16*d*.

The interlayer connecting conductor v1 is a conductor penetrating the insulator layers 26*b* to 26*f* in the up-down direction and forms a linear shape extending in the left-right direction when viewed from the upper side. The interlayer connecting conductor v1 is disposed in the rear half regions of the insulator layers 26*b* to 26*f* when viewed from the upper side and is connected to the inner circumferential end portions of the primary coil conductor layers 30*a*, 36.

The lead-out conductor layer 60 is disposed on the upper principal surface of the insulator layer 26*c* and does not forma spiral shape when viewed from the upper side. The lead-out conductor layer 60 relays the connection between the inner circumferential end portions of the primary coil conductor layers 30*a*, 36 and the external electrode 14*d* and, specifically, is connected to the interlayer connecting conductor v1 and connected to the connecting conductor 70*d*. As a result, the other end of the primary coil L1 (the inner circumferential end portions of the primary coil conductor layers 30*a*, 36) and the external electrode 14*d* are electrically connected through the lead-out part 53 (the interlayer connecting conductor v1, the lead-out conductor layer 60, and the connecting conductor 70*d*) and the connecting part 16*d*. Therefore, the circumferential direction of the primary coil L1 from the external electrode 14*a* to the external electrode 14*d* is clockwise when viewed from the upper side.

The secondary coil L2 is disposed in the main body 12 and includes a secondary coil conductor layer 32*a*. The secondary coil conductor layer 32*a* is disposed on the upper principal surface of the insulator layer 26*e* and forms a spiral shape spiraling clockwise from the outer circumferential side to the inner circumferential side when viewed from the upper side. In this embodiment, the secondary coil conductor layer 32*a* has a length of about four turns. The center of the secondary coil conductor layer 32*a* is substantially coincident with the center (intersection of diagonals) of the electronic component 10 when viewed from the upper side.

The lead-out part 51 connects one end of the secondary coil L2 (the outer circumferential end portion of the secondary coil conductor layer 32*a*) and the external electrode 14*b*. The lead-out part 51 includes a lead-out conductor layer 42*a* and the connecting conductor 70*b*. The connecting conductor 70*b* is a rectangular prism-shaped conductor disposed in the center of the long side located on the left side of the insulator layers 26*b* to 26*f*. The connecting conductor 70*b* extends in the up-down direction from the upper principal surface of the insulator layer 26*b* to the lower principal surface of the insulator layer 26*f* and is connected at the lower end thereof to the connecting part 16*b*.

The lead-out conductor layer 42*a* is disposed on the upper principal surface of the insulator layer 26*e* and is connected to the outer circumferential end portion of the secondary coil conductor layer 32*a* and connected to the connecting conductor 70*b*. The lead-out conductor layer 42*a* does not form a spiral shape when viewed from the upper side, and extends from the outer circumferential end portion of the secondary coil conductor layer 32*a* toward the left side. As a result, the one end of the secondary coil L2 (the outer circumferential end portion of the secondary coil conductor layer 32*a*) and the external electrode 14*b* are electrically connected through the lead-out part 51 (the lead-out conductor layer 42*a* and the connecting conductor 70*b*) and the connecting part 16*b*.

A lead-out part 54 connects the other end of the secondary coil L2 (the inner circumferential end portion of the secondary coil conductor layer 32*a*) and the external electrode 14*e*. The lead-out part 54 includes an interlayer connecting conductor v2, a lead-out conductor layer 62, and the connecting conductor 70*e*. The connecting conductor 70*e* is a rectangular prism-shaped conductor disposed in the center of the long side located on the right side of the insulator layers 26*b* to 26*f*. The connecting conductor 70*e* extends in the up-down direction from the upper principal surface of the insulator layer 26*b* to the lower principal surface of the insulator layer 26*f* and is connected at the lower end thereof to the connecting part 16*e*.

The interlayer connecting conductor v2 is a conductor penetrating the insulator layers 26*b* to 26*e* in the up-down direction and forms a linear shape extending in the left-right direction when viewed from the upper side. The interlayer connecting conductor v2 is disposed in the centers of the insulator layers 26*b* to 26*e* when viewed from the upper side and is connected to the inner circumferential end portion of the secondary coil conductor layer 32*a*.

The lead-out conductor layer 62 is disposed on the upper principal surface of the insulator layer 26*c* and does not form a spiral shape when viewed from the upper side. The lead-out conductor layer 62 relays the connection between the inner circumferential end portion of the secondary coil conductor layer 32*a* and the external electrode 14*e* and, specifically, the lead-out conductor layer 62 is connected to the interlayer connecting conductor v2 and connected to the connecting conductor 70*e*. As a result, the other end of the secondary coil L2 (the inner circumferential end portion of the secondary coil conductor layer 32*a*) and the external electrode 14*e* are electrically connected through the lead-out part 54 (the interlayer connecting conductor v2, the lead-out conductor layer 62, and the connecting conductor 70*e*) and the connecting part 16*e*. Therefore, the circumferential direction of the secondary coil L2 from the external electrode 14*b* to the external electrode 14*e* is clockwise when viewed from the upper side.

The tertiary coil L3 is disposed in the main body 12 and includes a tertiary coil conductor layer 34*a*. The tertiary coil conductor layer 34*a* is disposed on the upper principal surface of the insulator layer 26*d* and forms a spiral shape spiraling clockwise from the outer circumferential side to the inner circumferential side when viewed from the upper side. In this embodiment, the tertiary coil conductor layer 34*a* has a length of about four turns. The center of the tertiary coil conductor layer 34*a* is substantially coincident with the center (intersection of diagonals) of the electronic component 10 when viewed from the upper side.

The coil conductor layers 30*a*, 32*a*, 34*a*, 36 overlap with each other as shown in FIG. 2 when viewed in the lamination direction. Particularly, a region surrounded by the primary coil conductor layers 30*a*, 36 (inner magnetic path of the primary coil L1), a region surrounded by the secondary coil conductor layer 32*a* (inner magnetic path of the secondary coil L2), and a region surrounded by the tertiary coil conductor layer 34*a* (inner magnetic path of the tertiary coil L3) overlap with each other when viewed in the lamination direction. As a result, the primary coil L1, the secondary coil L2, and the tertiary coil L3 are magnetically coupled. To prevent the lead-out parts 50, 53, the lead-out parts 51, 54, and the lead-out parts 52, 55 from interfering with each other, both ends of the primary coil conductor layers 30*a*, 36, both ends of the secondary coil conductor layer 32*a*, and both ends of the tertiary coil conductor layer 34*a* are located at positions different from each other when viewed in the lamination direction. Specifically, the outer circumferential end portion of the secondary coil conductor layer 32*a* is located upstream in the clockwise direction as compared to the outer circumferential end portion of the primary coil conductor layers 30*a*, 36. The outer circumferential end portion of the tertiary coil conductor layer 34*a* is positioned upstream in the clockwise direction as compared to the outer circumferential end portion of the secondary coil conductor layer 32*a*. Similarly, the inner circumferential end portion of the secondary coil conductor layer 32*a* is located upstream in the clockwise direction as compared to the inner circumferential end portion of the primary coil conductor layers 30*a*, 36. The inner circumferential end portion of the tertiary coil conductor layer 34*a* is positioned upstream in the clockwise direction as compared to the inner circumferential end portion of the secondary coil conductor layer 32*a*. This makes the lengths of the coil conductor layers 30*a*, 36, 32*a*, 34*a* substantially the same. To magnetically couple the primary coil L1, the secondary coil L2, and the tertiary coil L3, only the inner magnetic paths of the coils L1 to L3 need to overlap when viewed in the lamination direction, and the coil conductor layer 30*a*, the coil conductor layer 32*a*, and the coil conductor layer 32*a* do not have to overlap with each other over the entire length.

The lead-out part 52 connects one end of the tertiary coil L3 (the outer circumferential end portion of the tertiary coil conductor layer 34*a*) and the external electrode 14*c*. The lead-out part 52 includes a lead-out conductor layer 44*a* and the connecting conductor 70*c*. The connecting conductor 70*c* is a triangular prism-shaped conductor disposed in the corner located at the left front of the insulator layers 26*b* to 26*f*. The connecting conductor 70*c* extends in the up-down direction from the upper principal surface of the insulator layer 26*b* to the lower principal surface of the insulator layer 26*f* and is connected at the lower end thereof to the connecting part 16*c*.

The lead-out conductor layer 44*a* is disposed on the upper principal surface of the insulator layer 26*d* and is connected to the outer circumferential end portion of the tertiary coil conductor layer 34*a* and connected to the connecting conductor 70*c*. The lead-out conductor layer 44*a* does not form a spiral shape when viewed from the upper side, and extends from the outer circumferential end portion of the tertiary coil conductor layer 34*a* toward the front side. As a result, the one end of the tertiary coil L3 (the outer circumferential end portion of the tertiary coil conductor layer 34*a*) and the external electrode 14*c* are electrically connected through the lead-out part 52 (the lead-out conductor layer 44*a* and the connecting conductor 70*c*) and the connecting part 16*c*.

The lead-out part 55 connects the other end of the tertiary coil L3 (the inner circumferential end portion of the tertiary coil conductor layer 34*a*) and the external electrode 14*f*. The lead-out part 55 includes an interlayer connecting conductor v3, a lead-out conductor layer 64, and the connecting conductor 70*f*. The connecting conductor 70*f* is a triangular prism-shaped conductor disposed in the corner located at the right front of the insulator layers 26*b* to 26*f*. The connecting conductor 70*f* extends in the up-down direction from the upper principal surface of the insulator layer 26*b* to the lower principal surface of the insulator layer 26*f* and is connected at the lower end thereof to the connecting part 16*f*.

The interlayer connecting conductor v3 is a conductor penetrating the insulator layers 26*b* to 26*d* in the up-down direction and forms a linear shape extending in the left-right direction when viewed from the upper side. The interlayer connecting conductor v3 is disposed in the front half regions of the insulator layers 26*b* to 26*d* when viewed from the upper side and is connected to the inner circumferential end portions of the tertiary coil conductor layer 34*a*.

The lead-out conductor layer 64 is disposed on the upper principal surface of the insulator layer 26*c* and does not forma spiral shape when viewed from the upper side. The lead-out conductor layer 64 relays the connection between the inner circumferential end portion of the tertiary coil conductor layer 34*a* and the external electrode 14*f* and, specifically, is connected to the interlayer connecting conductor v3 and connected to the connecting conductor 70*f*. As a result, the other end of the tertiary coil L3 (the inner circumferential end portion of the tertiary coil conductor layer 34*a*) and the external electrode 14*f* are electrically connected through the lead-out part 55 (the interlayer connecting conductor v3, the lead-out conductor layer 64, and the connecting conductor 70*f*) and the connecting part 16*f*. Therefore, the circumferential direction of the tertiary coil L3 from the external electrode 14*c* to the external electrode 14*f* is clockwise when viewed from the upper side.

Thus, the electronic component 10 has the circumferential direction of the primary coil L1 from the external electrode 14*a* (an example of a first external electrode) to the external electrode 14*d* (an example of a fourth external electrode), the circumferential direction of the secondary coil L2 from the external electrode 14*b* (an example of a second external electrode) to the external electrode 14*e* (an example of a fifth external electrode), and the circumferential direction of the tertiary coil L2 from the external electrode 14*c* (an example of a third external electrode) to the external electrode 14*f* (an example of a sixth external electrode) all defined in the same direction. Because of the symmetry of the electronic component 10, the circumferential directions from the respective external electrodes 14*d*, 14*e*, 14*f* to the respective external electrodes 14*a*, 14*b*, 14*c* are all the same.

The primary coil conductor layer 36 is disposed on the upper side with respect to the tertiary coil conductor layer 34*a* (an example of a predetermined tertiary coil conductor layer) disposed on the uppermost side among the coil conductor layers 30*a*, 32*a*, 34*a*, and the lead-out conductor layers 60, 62, 64.

The coil conductor layers 30*a*, 32*a*, 34*a*, 36, the lead-out conductor layers 40*a*, 42*a*, 44*a*, 46, 60, 62, 64, and the connecting conductors 70*a* to 70*f* are fabricated by the same material/method as the external electrodes 14*a* to 14*f*, for example. The coil conductor layers 30*a*, 32*a*, 34*a*, 36 and the lead-out conductor layers 40*a*, 42*a*, 44*a*, 46, 60, 62, 64 may be integrated, may be simultaneously formed conductor layers, or may be separately formed different conductor layers.

As described above, the primary coil L1 has the primary coil conductor layers 30*a*, 36 forming the same shape and connected in parallel to each other. The lengths of the coil conductor layers 30*a*, 32*a*, 34*a*, 36 are substantially identical to each other. Therefore, the primary coil L1, the secondary coil L2, and the tertiary coil L3 have current path lengths substantially identical to each other. The current path lengths being substantially the same means that since the lead-out parts 50 to 55 are arranged to prevent interference with each other as described above, differences in length generated in the coil conductor layers 30*a*, 32*a*, 34*a*, 36 are not substantial differences.

As shown in FIG. 3A, the electronic component 10 is an electronic component comprising a main body 12 including a plurality of the insulator layers 26*a* to 26*f* laminated in the up-down direction (lamination direction). Specifically, in the electronic component 10, the plurality of the insulator layers 26*a* to 26*f* includes three types of insulator layers, i.e., the insulator layer 26*e* (an example of the first insulator layer) including a portion interposed between the primary coil conductor layer 30*a* and the secondary coil conductor layer 32*a*; the insulator layer 26*d* (an example of the second insulator layer) including a portion interposed between the secondary coil conductor layer 32*a* and the tertiary coil conductor layer 34*a*; and the insulator layers 26*b*, 26*c* (an example of the third insulator layer) including a portion interposed between the tertiary coil conductor layer 34*a* and the primary coil conductor layer 36.

The electronic component 10 has an insulator layer different in permittivity from the other two types of the insulator layers among the three types of insulator layers, i.e., the insulator layers 26*b*, 26*c*, the insulator layer 26*d*, and the insulator layer 26*e*, described above.

In the electronic component 10, the sum of the cross-sectional area of the primary coil conductor layer 30*a* and the cross-sectional area of the primary coil conductor layer 36 is substantially the same as the cross-sectional area of the secondary coil conductor layer 32*a* and the cross-sectional area of the tertiary coil conductor layer 34*a*. More specifically, as shown in FIG. 3B, the line widths of the coil conductor layers 30*a*, 32*a*, 34*a*, 36 are w1 and are substantially the same as each other. However, the thickness of the coil conductor layers 32*a*, 34*a* is d1, and the thickness of the coil conductor layers 30*a*, 36 is d2. This d2 is a half of d1. Therefore, the cross-sectional areas of the coil conductor layers 30*a*, 36 are substantially the same as each other and are a half of the cross-sectional area of each of the coil conductor layers 32*a*, 34*a*. In other words, the sum of the cross-sectional areas of the primary coil conductor layers 30*a*, 36 is substantially the same as the cross-sectional area of the secondary coil conductor layer 32*a* and the cross-sectional area of the tertiary coil conductor layer 34*a*. In this case, the electrical resistance value of the primary coil conductor layers 30*a*, 36 is twice the electrical resistance value of the coil conductor layers 32*a*, 34*a*. Therefore, the primary coil conductor layer 30*a* and the primary coil conductor layer 36 are electrically connected in parallel. As a result, in the current paths of the primary coil L1, the secondary coil L2, and the tertiary coil L3, the cross-sectional area of the primary coil L1, the cross-sectional area of the secondary coil L2, and the cross-sectional area of the tertiary coil L3 are substantially the same. Thus, the electrical resistance value of the primary coil L1, the electrical resistance value of the secondary coil L2, and the electrical resistance value of the tertiary coil L3 are substantially the same as each other.

The cross-sectional area of the coil conductor layer in the above description means the cross-sectional area in the cross section orthogonal to the extending direction of the coil conductor layer. The thickness of the coil conductor layer is the thickness of the coil conductor layer in the up-down direction. The line width of the coil conductor layer is the width in the direction orthogonal to the up-down direction of the coil conductor layer in the cross section orthogonal to the extending direction of the coil conductor layer.

The interval between the two primary and secondary coil conductor layers 30*a* and 32*a* adjacent to each other in the up-down direction and the interval between the two secondary and tertiary coil conductor layers 32*a* and 34*a* adjacent to each other in the up-down direction are both D1 and are substantially the same as each other. Therefore, when the coil conductor layers 30*a*, 32*a*, 34*a* are considered as one coil conductor layer group, the intervals between those adjacent to each other in the up-down direction are substantially uniform in the coil conductor layer group. However, the interval between the tertiary coil conductor layer 34*a* and the primary coil conductor layer 36 is D2, which is larger than D1. This is because the lead-out conductor layers 60, 62, 64 are disposed between the primary coil conductor layer 36 and the tertiary coil conductor layer 34*a* in the up-down direction. As described above, in the electronic component 10, the intervals are not uniform between those adjacent to each other in the up-down direction among the coil conductor layers 30*a*, 32*a*, 34*a*, and the coil conductor layer 36. The interval between the coil conductor layers is the distance between surfaces facing each other between the two coil conductor layers. Intervals not being uniform is not limited to the case that all the intervals are different from each other, and may include the case that at least one interval is different from the remaining intervals. The remaining intervals may all be the same.

The operation of the electronic component 10 configured as described above will hereinafter be described. In the following description, it is assumed that the external electrodes 14*a* to 14*c* are used as input terminals while the external electrodes 14*d* to 14*f* are used as output terminals for the purpose of description; however, this relationship may be reversed. The circumferential direction of the primary coil L1 from the external electrode 14*a* to the fourth external electrode 14*d*, the circumferential direction of the secondary coil L2 from the external electrode 14*b* to the external electrode 14*e*, and the circumferential direction of the tertiary coil L3 from the external electrode 14*c* to the external electrode 14*f* are clockwise when viewed from the upper side and are all the same. Therefore, when a current flows from the input terminals (the external electrodes 14*a* to 14*c*) to the output terminals (the external electrodes 14*d* to 14*f*), the magnetic fluxes generated in the coils L1 to L3 have the same direction (e.g., when an electric current having a positive value is applied, magnetic fluxes are generated from the upper side to the lower side in the inner diameters of the coils L1 to L3).

To the external electrodes 14*a*, 14*b*, 14*c*, a first signal S1, a second signal S2, and a third signal S3 are respectively input. It is assumed that the first signal S1, the second signal S2, and the third signal S3 are as follows. The first signal S1, the second signal S2, and the third signal S3 respectively take arbitrary three voltage values of high (H), middle (M), and low (L) different from each other and transit among the three values H, M, L under the same clock. Additionally, at the timing of a certain signal taking the value of H, one of the remaining two signals takes the value of M and the other takes the value of L. In other words, the first signal S1, the second signal S2, and the third signal S3 exclusively transit among three values of H, M, L. In this case, the sum of the voltage values of the first signal S1, the second signal S2, and the third signal S3 is almost always constant (H+M+L), and a "total" change amount of the voltage due to the transition is almost zero. Therefore, a "total" change amount of the current generated in the primary coil L1, the secondary coil L2, and the tertiary coil L3 is also substantially zero, and the change amount of the magnetic flux generated in the electronic component 10 is substantially "0" (although the generated magnetic flux changes in each of the primary coil L1, the secondary coil L2, and the tertiary coil L3, these changes cancel each other). When substantially no change occurs in the magnetic flux in this way, no impedance is substantially generated in the electronic component 10 and, therefore, the electronic component 10 does not affect the first signal S1, the second signal S2, and the third signal S3.

On the other hand, because of the relationship of the circumferential direction of the coils L1 to L3 described above, the respective magnetic flux changes generated by the primary coil L1, the secondary coil L2 and the tertiary coil L3 are in the same direction with respect to common mode noises, i.e., in-phase noises included in the first signal S1, the second signal S2, and the third signal S3, and these magnetic flux changes strengthen each other rather than canceling each other. Therefore, the electronic component 10 has a large impedance to the common mode noises and can reduce the common mode noises. As described above, the electronic component 10 does not affect the first signal S1, the second signal S2, and the third signal S3 and can reduce the common mode noises, and the primary coil L1, the secondary coil L2 and the tertiary coil L3 constitute a common mode filter for the first signal S1, the second signal S2, and the third signal S3.

(Method of Manufacturing Electronic Component)

An example of a method of manufacturing the electronic component 10 will hereinafter be described with reference to the drawings. In the following description, the case of manufacturing the one electronic component 10 is taken as an example; however, actually, large-sized mother magnetic material substrates and mother insulator layers are laminated to fabricate a mother main body, and the mother main body is cut to form a plurality of the electronic components 10 at the same time.

First, a polyimide resin is applied as a photosensitive resin to the entire upper principal surface of the magnetic material substrate 20*b*. Subsequently, after the positions corresponding to the four corners and the centers of the two long sides of the insulator layer 26*f* are light-shielded, the resin is exposed to light. As a result, the polyimide resin is cured in the portion without the light shielding. Subsequently, removal of photoresist by an organic solvent is followed by development to remove the uncured polyimide resin before heat curing. As a result, the insulator layer 26*f* is formed.

Subsequently, an Ag film is formed by a sputtering method on the insulator layer 26*f* and the magnetic material substrate 20*b* exposed from the insulator layer 26*f*. A photoresist is then formed on a portion in which the primary coil conductor layer 30*a*, the lead-out conductor layer 40*a*, the connecting conductors 70*a* to 70*f*, and the interlayer connecting conductor v1 are formed. The Ag film is then removed by an etching method except the portion in which the primary coil conductor layer 30*a*, the lead-out conductor layer 40*a*, the connecting conductors 70*a* to 70*f*, and the interlayer connecting conductor v1 are formed (i.e., the portion covered with the photoresist). Subsequently, the photoresist is removed by an organic solvent to form the primary coil conductor layer 30*a*, the lead-out conductor layer 40*a*, portions (corresponding to one layer) of the connecting conductors 70*a* to 70*f*, and the interlayer connecting conductor v1.

The same process as the process described above is repeated to form the insulator layers 26*a* to 26*e* and the coil conductor layers 32*a*, 34*a*, 36, the lead-out conductor layers 42*a*, 44*a*, 46, 60, 62, 64, the remaining portions of the connecting conductors 70*a* to 70*f*, and the interlayer connecting conductors v2, v3.

Subsequently, a magnetic material paste serving as the magnetic material layer 24 is applied onto the laminated body 22, and the magnetic material substrate 20*a* is pressure-bonded onto the magnetic material layer 24.

Subsequently, six cutouts are formed in the magnetic material substrate 20*b* by a sandblasting method. In addition to the sandblasting method, the cutouts may be formed by a laser processing method, or may be formed by a combination of the sandblasting method and the laser processing method.

Lastly, conductor layers are formed on the inner circumferential surfaces of the cutouts of the magnetic material substrate 20*b* by a combination of an electrolytic plating method and a photolithography method to form the connecting parts 16*a* to 16*f* and the external electrodes 14*a* to 14*f*.

(Effects)

According to the electronic component 10 related to this embodiment, a difference in differential impedance between the coils L1 to L3 can be adjusted. When a measurement current (or a differential signal) is applied, the differential impedance is represented by $\sqrt{L/C}$, where L is the inductance value of the entire electronic component 10 including the coils and C is the capacitance value. C includes the capacitance (parasitic capacitance) between the coil conductor layers. As described above, the electronic component 10 has an insulator layer different in permittivity from the other two types of the insulator layers among the three types of insulator layers, i.e., the insulator layers 26*b*, 26*c*, the insulator layer 26*d*, and the insulator layer 26*e*. For example, it is assumed that the permittivity of the insulator layer 26*e* is larger than the permittivity of the other two types of the insulator layers 26*b*, 26*c*, 26*d*. In this case, the capacitance generated between the primary coil conductor layer 30*a* and the secondary coil conductor layer 32*a* with the insulator layer 26*e* interposed therebetween becomes larger as compared to when the insulator layer 26*e* has the same permittivity as the insulator layers 26*b*, 26*c*, 26*d*, so that the differential impedance between the primary coil L1 and the secondary coil L2 (hereinafter referred to as I12) can be lowered. Similarly, if the permittivity of the insulator layer 26*e* is lower than the permittivity of the other two types of the insulator layers 26*b*, 26*c*, 26*d*, I12, the differential impedance can be raised. Therefore, if the permittivity of the insulator layer 26*e* is different from the permittivity of the other two types of the insulator layers 26*b*, 26*c*, 26*d*, I12, the differential impedance can be adjusted. For the same reason, if the permittivity of the insulator layer 26*d* is different from the permittivity of the other two types of the insulator layers 26*b*, 26*c*, 26*e*, the differential impedance between the secondary coil L2 and the tertiary coil L3 (hereinafter referred to as I23) can be adjusted. If the permittivity of at least one of the insulator layers 26*b*, 26*c* is different from the permittivity of the other two types of the insulator layers 26*d*, 26*e*, the differential impedance between the primary coil L1 and the tertiary coil L3 (hereinafter referred to as I31) can be adjusted.

Figure 13:
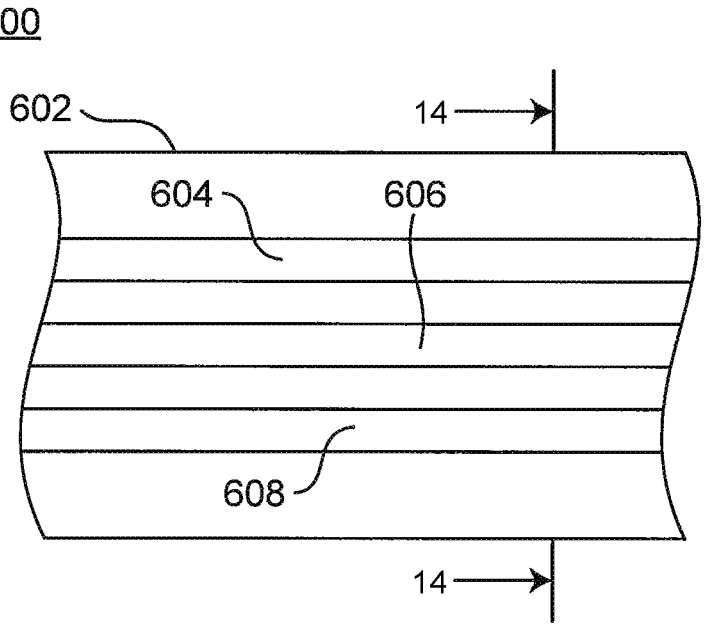
FIG. 13 is a plane view of a circuit board 600 on which the common mode choke coil 510 is mounted.
Figure 14:
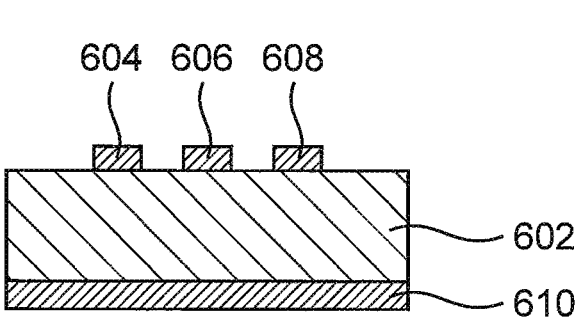
FIG. 14 is a cross-sectional structural view of the circuit board 600 on which the common mode choke coil 510 is mounted.

Additionally, according to the electronic component 10, as described below, when the permittivity of at least one or both of the insulator layers 26*b*, 26*c* is different from the permittivity of the insulator layers 26*d*, 26*e* and, for example, the electronic component 10 is mounted on a circuit board 600 shown in FIGS. 13 and 14, matching can be achieved for the differential impedance between the coils L1 to L3 and the differential impedance between signal lines 604, 606, 608.

The electronic component 10 includes the external electrodes 14*a*, 14*d* respectively electrically connected to one end and the other end of the primary coil L1, the external electrodes 14*b* and 14*e* respectively electrically connected to one end and the other end of the secondary coil L2, and the external electrodes 14*c* and 14*f* respectively electrically connected to one end and the other end of the tertiary coil L3. In the electronic component 10, the external electrodes 14*a*, 14*b*, 14*c* and the external electrodes 14*d*, 14*e*, 14*f* are arranged in this order in the direction from the rear side to the front side on the lower surface of the main body 12 (the lower principal surface of the magnetic material substrate 20*b*).

In this case, because of the relationship between the arrangement of the external electrodes 14*a* to 14*f* and the arrangement of the signal lines 604, 606, 608 in the circuit board 600, the primary coil L1 is connected to the signal line 604, the secondary coil L2 is connected to the signal line 606, and the tertiary coil L3 is connected to the signal line 608.

In the electronic component 10, the primary coil conductor layer 36 is disposed on the upper side with respect to the tertiary coil conductor layer 34*a* disposed on the uppermost side among the coil conductor layers 30*a*, 32*a*, 34*a*. As a result, the capacitance is generated also between the tertiary coil conductor layer 34*a* and the primary coil conductor layer 36. Therefore, as compared to the case without the primary coil conductor layer 36, the capacitance between the primary coil L1 and the tertiary coil L3 can be brought closer to the capacitance between the primary coil L1 and the secondary coil L2 and the capacitance between the secondary coil L2 and the tertiary coil L3. In other words, I12, I23, I31 comes closer to each other.

However, the differential impedance between the signal line 604 and the signal line 608 (hereinafter referred to as I84) is larger than the differential impedance between the signal line 604 and the signal line 606 (hereinafter referred to as I46) and the differential impedance between the signal line 606 and the signal line 608 (hereinafter referred to as I68). Therefore, when I12, I23, and I31 are made equal, I31 becomes smaller than I84 in the case of matching I12 and I46 and matching I23 and I68. In this case, a high-frequency signal may be reflected between the electronic component 10 and the circuit board 600, which may result in deformation of the waveform of the high-frequency signal.

Therefore, in the electronic component 10, the interval (D2) between the tertiary coil conductor layer 34*a* and the primary coil conductor layer 36 is larger than the interval between the primary coil conductor layer 30*a* and the secondary coil conductor layer 32*a* and the interval (D1) between the secondary coil conductor layer 32*a* and tertiary coil conductor layer 34*a*. As a result, the capacitance generated between the tertiary coil L3 and the primary coil L1 becomes smaller than the capacitance generated between the primary coil L1 and the secondary coil L2 and the capacitance generated between the secondary coil L2 and the tertiary coil L3. Thus, I31 becomes higher than I12 and I23. Consequently, the matching of I31 and I84 can be achieved.

However, when such matching is achieved, it is preferable that the differential impedance can finely be adjusted. In this regard, in the electronic component 10, the permittivity of at least one or both of the insulator layers 26*b*, 26*c* is different from the permittivity of the insulator layers 26*d*, 26*e* and, therefore, I31 can be adjusted. As a result, in the electronic component 10, the matching of I12, I23, I31 and I46, I68, I84 can more easily be achieved. It is noted that because of the symmetry of the electronic component 10 and the circuit board 600, the same applies to the case of connecting the primary coil L1 to the signal line 608, the secondary coil L2 to the signal line 606, and the tertiary coil L3 to the signal line 604.

To clarify that the differential impedance can be adjusted in the electronic component 10, the inventor of the present application conducted a computer simulation described below. More specifically, a first model related to a comparative example was acquired by setting the permittivity of the insulator layers 26*a* to 26*f* described above equal to 3 in the same structure as the electronic component 10. A second model related to an example was acquired by setting the permittivity of the insulator layer 26*b* to 10 and setting the permittivity of the other insulator layers 26*a*, 26*c*, 26*d*, 26*e*, 26*f* to 3 to achieve a configuration having the permittivity of the insulator layer 26*b* different from the permittivity of the insulator layers 26*d*, 26*e*. In the first model and the second model, I12, I23, and I31 were calculated. In the calculation, for example, when I12 was calculated, a differential signal was input to the primary coil L1 and the secondary coil L2, and the tertiary coil L3 was terminated at 50Ω to the ground potential.

Figure 4:
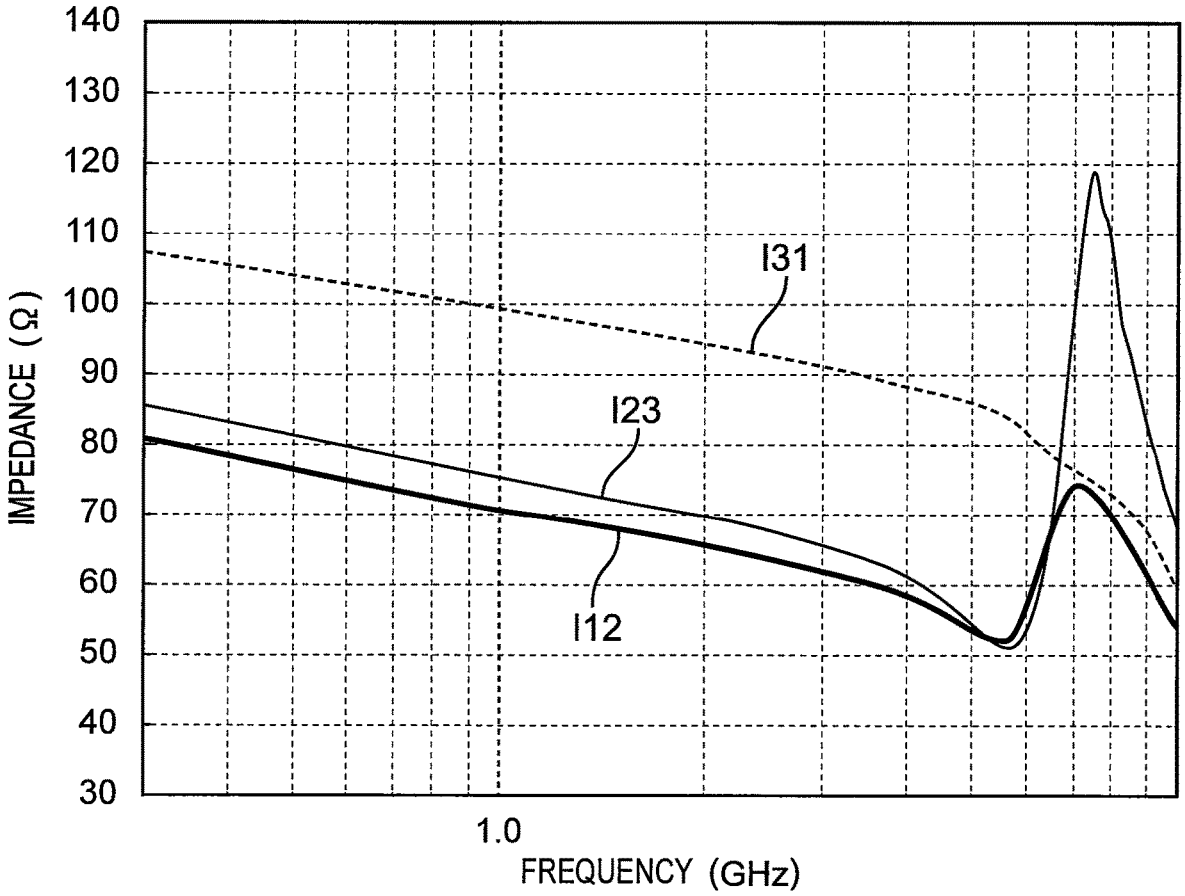
FIG. 4 is a graph of simulation results of a first model.
Figure 5:
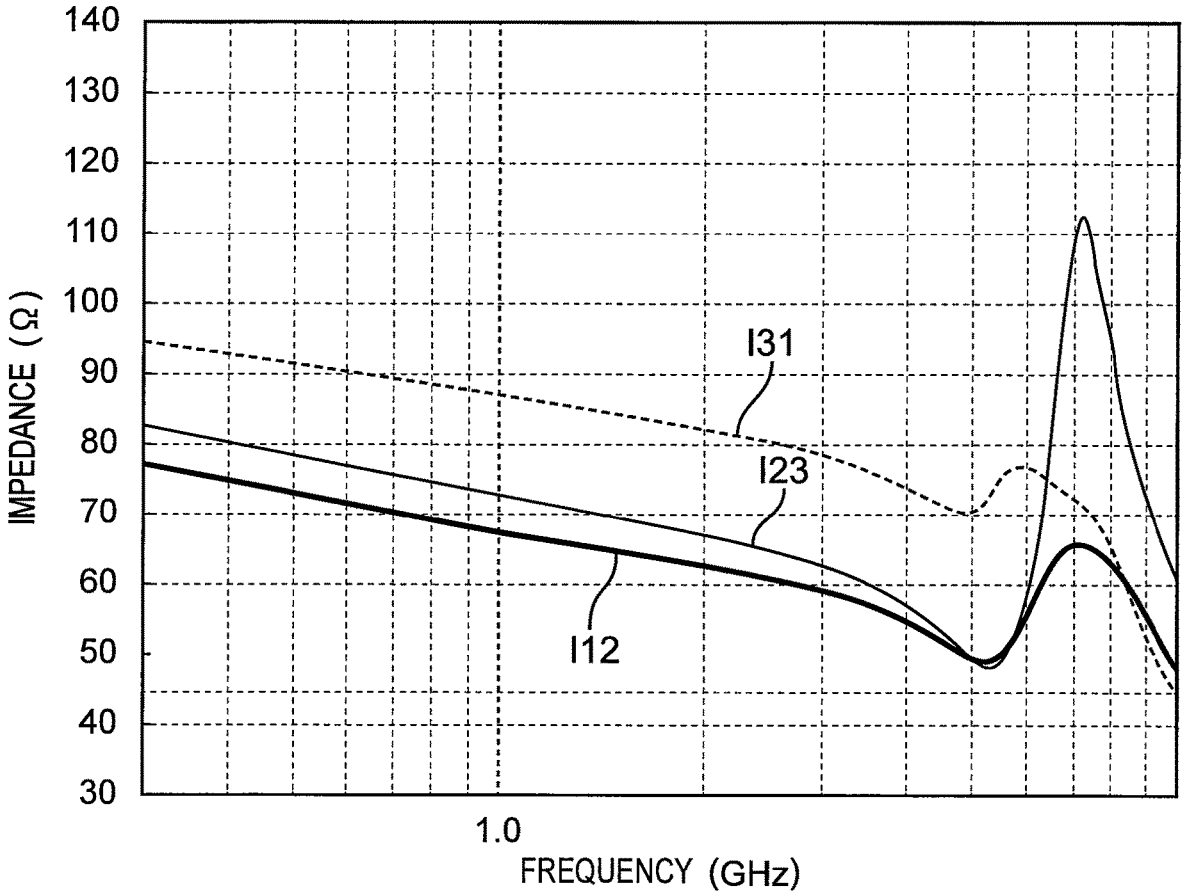
FIG. 5 is a graph of simulation results of a second model.

FIG. 4 is a graph of simulation results of the first model. FIG. 5 is a graph of simulation results of the second model. In FIGS. 4 and 5, the vertical axis indicates a differential impedance and the horizontal axis indicates a frequency.

As shown in FIGS. 4 and 5, in the second model in which the permittivity of the insulator layer 26*b* is different from the permittivity of the other insulator layers 26*d*, 26*e* among the insulator layer 26*e* (the first insulator layer) and the insulator layers 26*d* (the second insulator layer), 26*b*, 26*c* (the third insulator layer), I31 can be brought closer to I12 and I23 as compared to the first model. Therefore, the configuration of the electronic component 10 enables adjustment of the difference between I31, I23, and I12.

First Modification Example

In this embodiment, the permittivity of only one insulator layer among the insulator layers 26*a* to 26*f* described above is set large; however, this is not a limitation of the electronic component of the embodiment of the present disclosure. For example, I31, I23, and I12 may be adjusted by changing the permittivity of a plurality of insulator layers among the insulator layers 26*a* to 26*f* described above. A first modified example will hereinafter be described.

This modification example is formed such that the permittivity of insulator layers 26*a* to 26*c*, 26*f* becomes larger than the other insulator layers 26*d*, 26*e*. Therefore, the permittivity of the insulator layer 26*d* and the permittivity of the insulator layer 26*e* are smaller than the permittivity of the other insulator layers 26*a* to 26*c*, 26*f*.

To clarify that the differential impedance can be adjusted in the first modification example, the inventor of the present application conducted a computer simulation described below. More specifically, a third model related to the first modification example was acquired by setting the permittivity of the insulator layers 26*a* to 26*c* and 26*f* to 10, the permittivity of the insulator layer 26*e* to 2, and the permittivity of the insulator layer 26*d* to 2.5 in the same structure as the electronic component 10 to achieve a configuration in which the permittivity of a plurality of insulator layers was different. I12, I23, and I31 were then calculated in the third model. In the calculation, for example, when I12 was calculated, a differential signal was input to the primary coil L1 and the secondary coil L2, and the tertiary coil L3 was terminated at 50Ω to the ground potential.

Figure 6:
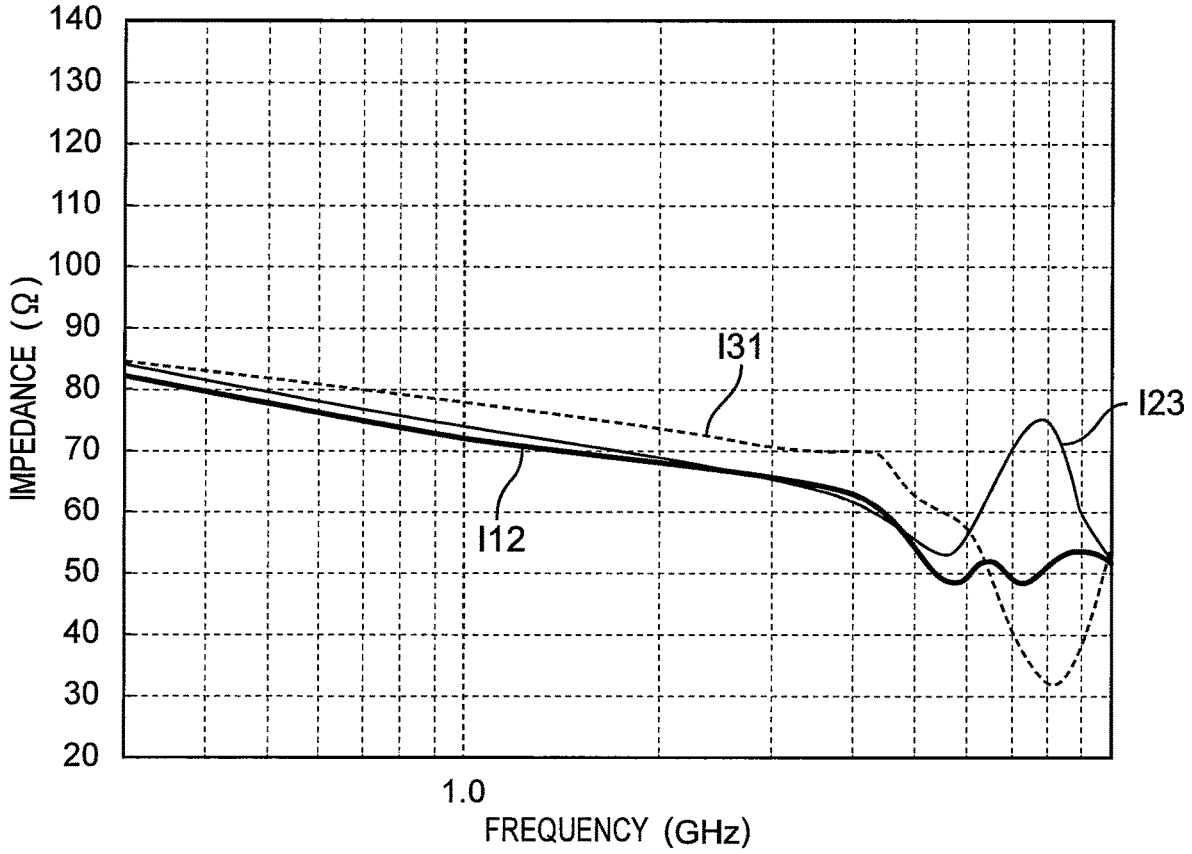
FIG. 6 is a graph of simulation results of a third model

FIG. 6 is a graph of simulation results of the third model. In FIG. 6, the vertical axis indicates a differential impedance and the horizontal axis indicates a frequency. As shown in FIGS. 4 and 6, in the third model in which the permittivity of the insulator layers 26*d*, 26*e* is different from the permittivity of the other insulator layers 26*b*, 26*c* among the insulator layer 26*e* (the first insulator layer) and the insulator layers 26*d* (the second insulator layer), 26*b*, 26*c* (the third insulator layer), I31 can be brought closer to I12 and I23 as compared to the first model. Therefore, the configuration of the first modification example also enables adjustment of the differential impedances I31, I23, I12. Furthermore, as shown in FIGS. 5 and 6, in a third model in which the permittivity of all the insulator layers (the insulator layers 26*b*, 26*c*) constituting the third insulator layer is larger than the permittivity of the other insulator layers 26*d*, 26*e*, a range of reduction of the differential impedance I31 can be made larger as compared to the second model, so that the differential impedances I31, I23, and I12 can be brought further closer to each other. As described above, when one of the three types of insulator layers is made up of a plurality of insulator layers, a difference in differential impedance can be adjusted also by adjusting the number of the insulator layers having the permittivity different from the permittivity of the other two types of the insulator layers.

As shown in FIGS. 5 and 6, in the third model in which the permittivity of the insulator layer 26*e* (the first insulator layer) is different from the permittivity of the insulator layer 26*d* (second insulator layer), I12 and I23 can be brought closer as compared to the second model in which the insulator layers 26*d*, 26*e* have the same permittivity. As described above, in the electronic component 10, the differential impedance can be adjusted to a greater extent by changing the permittivity of a plurality of insulator layers among the insulator layers 26*b* to 26*e*.

Second Modification Example

Figure 7A:
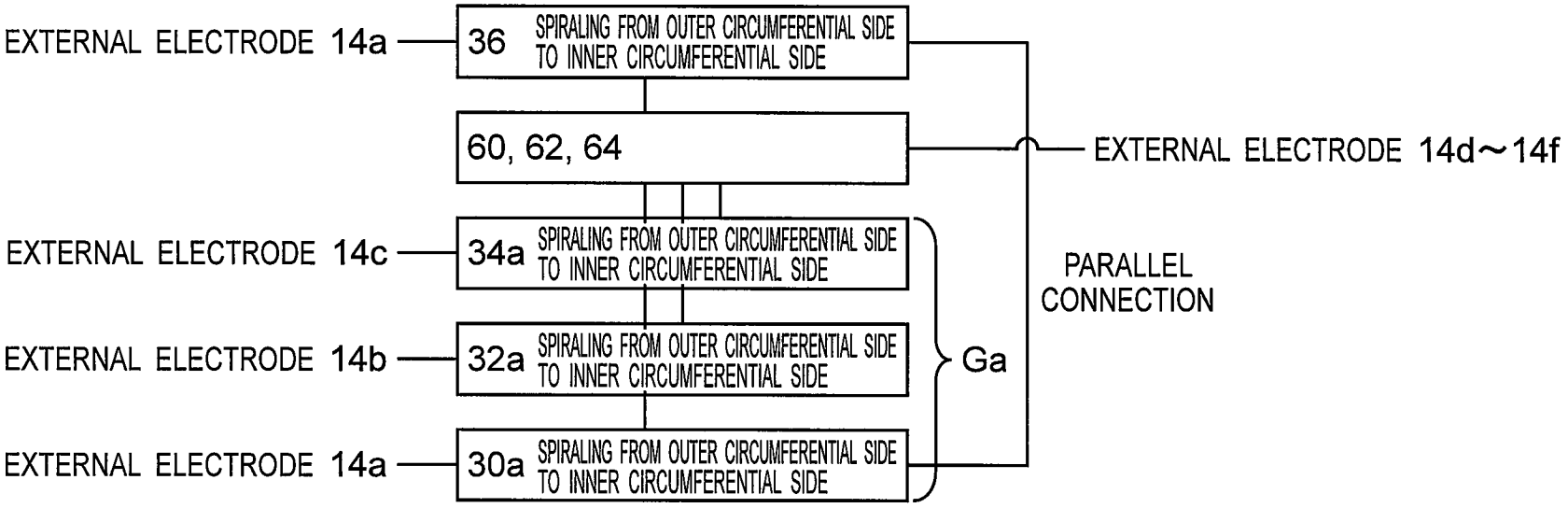
FIG. 7A is a schematic view of a positional relationship of coil conductor layers 30*a*, 32*a*, 34*a*, 36 of the electronic component 10.
Figure 7B:
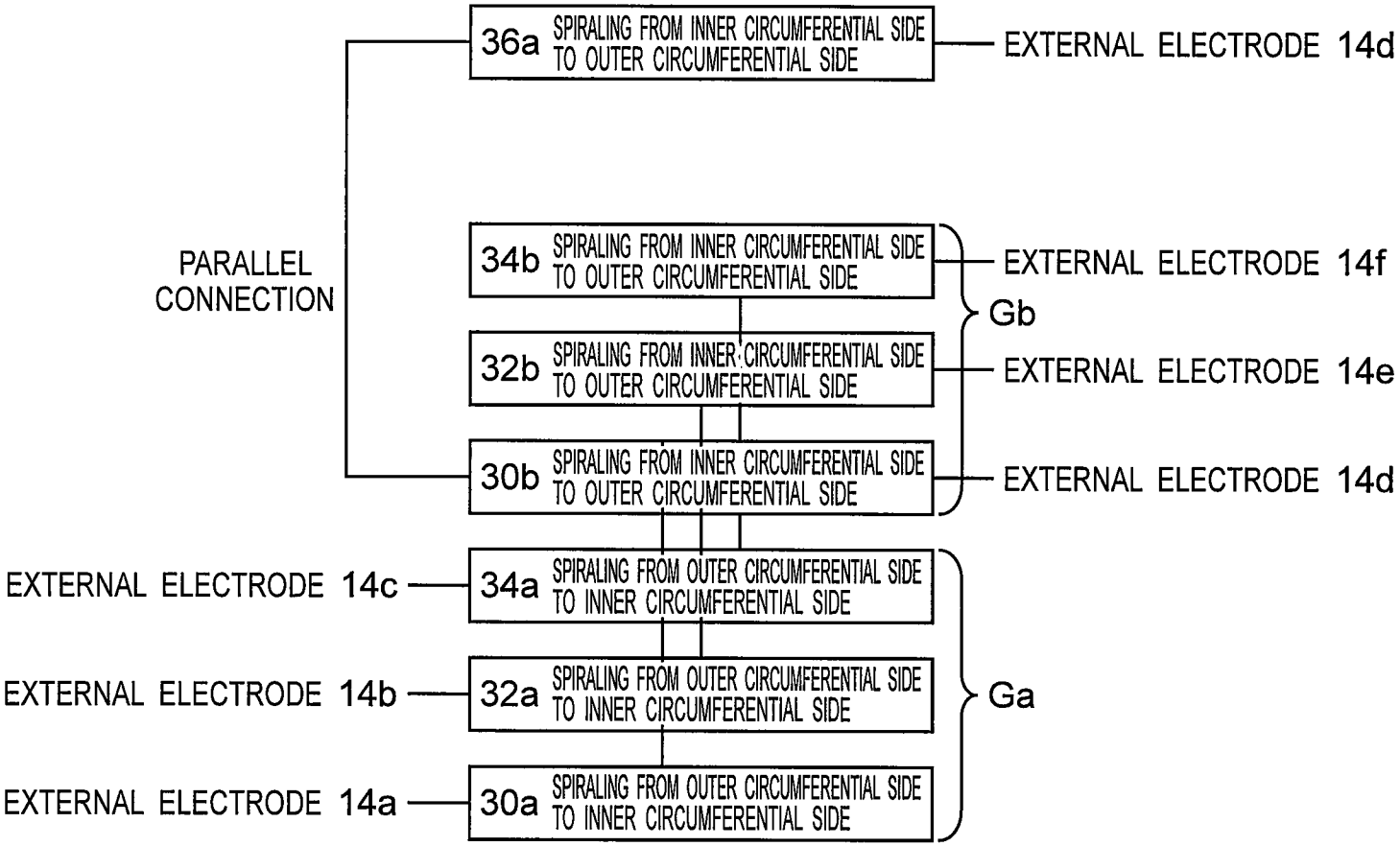
FIG. 7B is a schematic view of a positional relationship of coil conductor layers 30*a*, 32*a*, 34*a*, 30*b*, 32*b*, 34*b*, 36*a* of an electronic component 10*a*.

A configuration of an electronic component 10*a* according to a second modification example will hereinafter be described with reference to the drawings. In the electronic component 10*a*, the portions having basically the same configuration as the electronic component 10 are denoted by the same reference numerals as those of the electronic component 10 and will not thoroughly be described. FIG. 7A is a schematic of a positional relationship of the coil conductor layers 30*a*, 32*a*, 34*a*, 36 of the electronic component 10. FIG. 7B is a schematic of a positional relationship of coil conductor layers 30*a*, 32*a*, 34*a*, 30*b*, 32*b*, 34*b*, 36*a* of the electronic component 10*a*.

In the electronic component 10, the primary coil L1 includes the one series primary coil conductor layer 30*a* and one parallel primary coil conductor layer 36; the secondary coil L2 includes the one secondary coil conductor layer 32*a*; and the tertiary coil L3 includes the one tertiary coil conductor layer 34*a*. On the other hand, in the electronic component 10*a*, a primary coil L1*a* includes the two series primary coil conductor layers 30*a*, 30*b* and the one parallel primary coil conductor layer 36*a*; a secondary coil L2*a* includes the two secondary coil conductor layers 32*a*, 32*b*; and a tertiary coil L3*a* includes the two tertiary coil conductor layers 34*a*, 34*b*. Therefore, as described below, the electronic component 10*a* has differences in the coil conductor layers 30*b*, 32*b*, 34*b*, 36*a* from the electronic component 10.

In the electronic component 10, as shown in FIG. 7A, the series primary coil conductor layer 30*a*, the secondary coil conductor layer 32*a*, and the tertiary coil conductor layer 34*a* are arranged one by one in this order from the lower side to the upper side as one coil conductor layer group Ga. The primary coil conductor layer 36 has the same shape as the predetermined series primary coil conductor layer 30*a* and is electrically connected in parallel to the predetermined series primary coil conductor layer 30*a* and is disposed on the upper side with respect to the tertiary coil conductor layer 34*a* disposed on the uppermost side.

On the other hand, in the electronic component 10*a*, as shown in FIG. 7B, the series primary coil conductor layer 30*a*, the secondary coil conductor layer 32*a*, and the tertiary coil conductor layer 34*a* are arranged one by one in this order from the lower side to the upper side to constitute the coil conductor layer group Ga. Additionally, the series primary coil conductor layer 30*b*, the secondary coil conductor layer 32*b*, and the tertiary coil conductor layer 34*b* are arranged one by one in this order from the lower side to the upper side to constitute a coil conductor layer group Gb. The two coil conductor layer groups Ga, Gb are arranged side by side from the lower side to the upper side. The parallel primary coil conductor layer 36*a* has the same shape as the predetermined series primary coil conductor layer 30*b* and is electrically connected in parallel to the predetermined series primary coil conductor layer 30*b* and is disposed on the upper side with respect to the tertiary coil conductor layer 34*b* (predetermined tertiary coil conductor layer) disposed on the uppermost side.

Figure 8A:
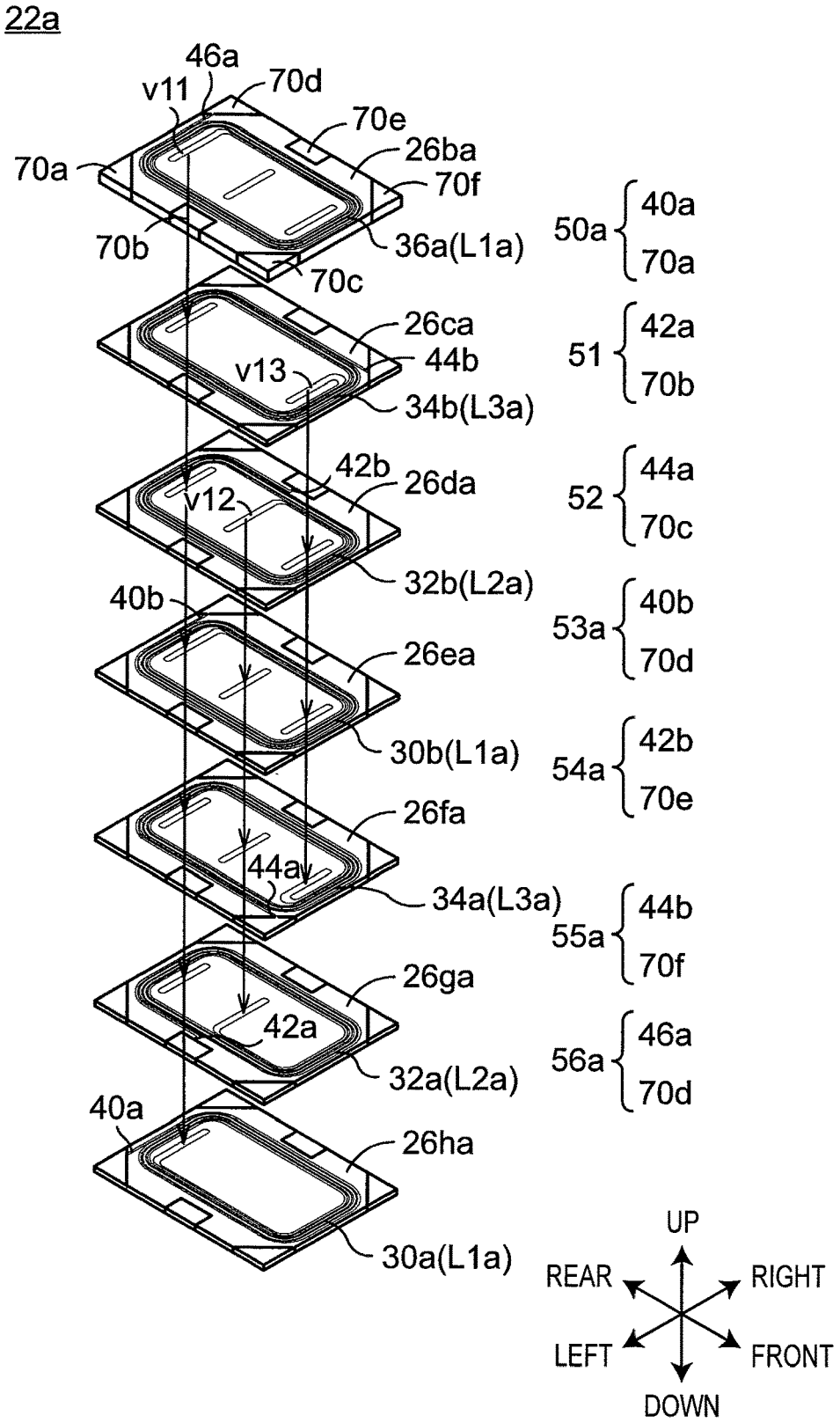
FIG. 8A is an exploded perspective view of a laminated body 22*a* of the electronic component 10*a*.
Figure 8B:
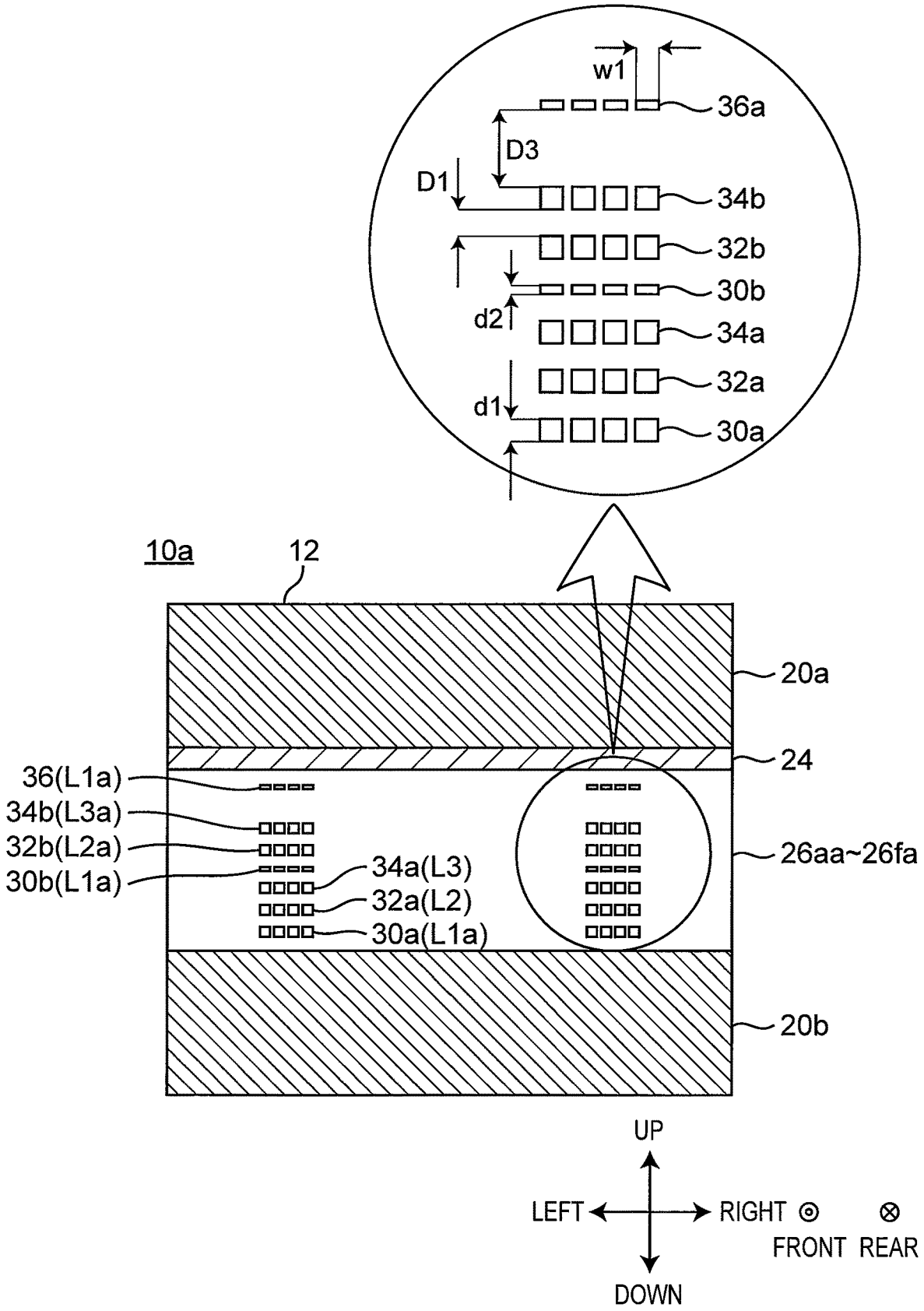
FIG. 8B is a schematic cross-sectional view of the electronic component 10*a*.

The configuration of the electronic component 10*a* will hereinafter be described in more detail with reference to the drawings. FIG. 8A is an exploded perspective view of a laminated body 22*a* of the electronic component 10*a*. It is noted that in FIG. 8A, an insulator layer 26*aa* corresponding to the insulator layer 26*a* of the electronic component 10 is not shown. FIG. 8B is a schematic cross-sectional view of the electronic component 10*a*. The cross section of FIG. 8B corresponds to the cross section of FIG. 3. The exterior appearance of the electronic component 10*a* is the same as the electronic component 10.

The laminated body 22*a* includes insulator layers 26*aa* to 26*ha* and forms a rectangular shape when viewed from the upper side. The shape and material of the insulator layers 26*aa*, 26*ca* to 26*ha* of the electronic component 10*a* are the same as the shape and material of the insulator layers 26*a* to 26*f* of the electronic component 10. Although the insulator layer 26*ba* is the same as the insulator layers 26*aa*, 26*ca* to 26*ha* in terms of the shape viewed from the upper side and the material, the thickness thereof is larger than the thickness of the insulator layers 26*aa*, 26*ca* to 26*ha*.

The primary coil L1*a* is disposed in the laminated body 22*a* and includes the primary coil conductor layer 30*a*, 30*b*, 36*a* and an interlayer connecting conductor v11. The primary coil conductor layer 30*a* of the electronic component 10*a* is the same as the primary coil conductor layer 30*a* of the electronic component 10 except being disposed on the upper principal surface of the insulator layer 26*ha*. A lead-out part 50*a* of the electronic component 10*a* is the same as the lead-out part 50 of the electronic component 10 except that the connecting conductor 70*a* is disposed over the insulator layers 26*ba* to 26*ha*, that the lead-out conductor layer 40*a* is disposed on the upper principal surface of the insulator layer 26*ha*, and that the lead-out conductor layer 46 is not included.

The primary coil conductor layers 30*b*, 36*a* are respectively disposed on the upper principal surfaces of the insulator layers 26*ea*, 26*ba* and form a spiral shape spiraling clockwise (an example of a predetermined direction) from the inner circumferential side to the outer circumferential side when viewed from the upper side. In this embodiment, the primary coil conductor layers 30*b*, 36*a* have a length of about four turns. The centers of the primary coil conductor layers 30*b*, 36*a* are substantially coincident with the center (intersection of diagonals) of the electronic component 10*a* when viewed from the upper side. The primary coil conductor layers 30*b*, 36*a* form the same shape and are electrically connected in parallel. Therefore, in this modification example, the primary coil conductor layer 30*a* corresponds to the other series primary coil conductor layers, the primary coil conductor layer 36*a* corresponds to a parallel primary coil conductor layer, and the primary coil conductor layer 30*b* corresponds to a predetermined series primary coil conductor layer. However, the primary coil conductor layer 36*a* may be the predetermined series primary coil conductor layer, and the primary coil conductor layer 30*b* may be the parallel primary coil conductor layer.

The interlayer connecting conductor v11 is a conductor penetrating the insulator layers 26*ba* to 26*ha* in the up-down direction and forms a linear shape extending in the left-right direction when viewed from the upper side. The interlayer connecting conductor v11 is disposed in the rear half regions of the insulator layers 26*ba* to 26*ha* when viewed from the upper side and connects the inner circumferential end portion of the primary coil conductor layer 30*a* and the inner circumferential end portions of the primary coil conductor layers 30*b*, 36*a*.

A lead-out part 53*a* connects the other end of the primary coil L1*a* (outer circumferential end portions of the primary coil conductor layers 30*b*, 36*a*) and the external electrode 14*d*. The lead-out part 53*a* includes lead-out conductor layers 40*b*, 46*a* and the connecting conductor 70*d*. The connecting conductor 70*d* is a triangular prism-shaped conductor disposed in the corner located at the right rear of the insulator layers 26*ba* to 26*ha*. The connecting conductor 70*d* extends in the up-down direction from the upper principal surface of the insulator layer 26*ba* to the lower principal surface of the insulator layer 26*ha* and is connected at the lower end thereof to the connecting part 16*d*.

The lead-out conductor layers 40*b*, 46*a* are respectively disposed on the upper principal surfaces of the insulator layers 26*ea*, 26*ba* and connected to outer circumferential end portions of the primary coil conductor layers 30*b*, 36*a* and are connected to the connecting conductor 70*d*. The lead-out conductor layers 40*b*, 46*a* do not form a spiral shape when viewed from the upper side, and extend from the outer circumferential end portions of the primary coil conductor layers 30*b*, 36*a* toward the right side. As a result, the other end of the primary coil L1*a* (the outer circumferential end portions of the primary coil conductor layers 30*b*, 36*a*) and the external electrode 14*d* are electrically connected through the lead-out part 53*a* (the lead-out conductor layers 40*b*, 46*a* and the connecting conductor 70*d*) and the connecting part 16*d*.

The secondary coil L2*a* is disposed in the laminated body 22*a* and includes the secondary coil conductor layers 32*a*, 32*b* and an interlayer connecting conductor v12. The secondary coil conductor layer 32*a* of the electronic component 10*a* is the same as the coil conductor layer 32*a* of the electronic component 10 except being disposed on the upper principal surface of the insulator layer 26*ga*. A lead-out part 51*a* of the electronic component 10*a* is the same as the lead-out part 51 of the electronic component 10 except that the connecting conductor 70*b* is disposed over the insulator layers 26*ba* to 26*ba* and that the lead-out conductor layer 42*a* is disposed on the upper principal surface of the insulator layer 26*ga*.

The secondary coil conductor layer 32*b* is disposed on the upper principal surface of the insulator layer 26*da* and forms a spiral shape spiraling clockwise from the inner circumferential side to the outer circumferential side when viewed from the upper side. In this embodiment, the secondary coil conductor layer 32*b* has a length of about four turns. The center of the secondary coil conductor layer 32*b* is substantially coincident with the center (intersection of diagonals) of the electronic component 10*a* when viewed from the upper side.

The interlayer connecting conductor v12 is a conductor penetrating the insulator layers 26*da* to 26*ga* in the up-down direction and forms a linear shape extending in the left-right direction when viewed from the upper side. The interlayer connecting conductor v12 is disposed in the centers of the insulator layers 26*da* to 26*ga* when viewed from the upper side and connects the inner circumferential end portion of the secondary coil conductor layer 32*a* and the inner circumferential end portion of the secondary coil conductor layer 32*b*.

A lead-out part 54*a* connects the other end of the secondary coil L2*a* (the outer circumferential end portion of the secondary coil conductor layer 32*b*) and the external electrode 14*e*. The lead-out part 54*a* includes a lead-out conductor layer 42*b* and the connecting conductor 70*e*. The connecting conductor 70*e* is a rectangular prism-shaped conductor disposed in the center of the long side located on the right side of the insulator layers 26*ba* to 26*ha*. The connecting conductor 70*e* extends in the up-down direction from the upper principal surface of the insulator layer 26*ba* to the lower principal surface of the insulator layer 26*ha* and is connected at the lower end thereof to the connecting part 16*e*.

The lead-out conductor layer 42*b* is disposed on the upper principal surface of the insulator layer 26*da* and is connected to the outer circumferential end portion of the secondary coil conductor layer 32*b* and connected to the connecting conductor 70*e*. The lead-out conductor layer 42*b* does not form a spiral shape when viewed from the upper side, and extends from the outer circumferential end portion of the secondary coil conductor layer 32*b* toward the right side. As a result, the other end of the secondary coil L2*a* (the outer circumferential end portion of the secondary coil conductor layer 32*b*) and the external electrode 14*e* are electrically connected through the lead-out part 54*a* (the lead-out conductor layer 42*b* and the connecting conductor 70*e*) and the connecting part 16*e*.

The tertiary coil L3*a* is disposed in the laminated body 22*a* and includes the tertiary coil conductor layers 34*a*, 34*b* and an interlayer connecting conductor v13. The tertiary coil conductor layer 34*a* of the electronic component 10*a* is the same as the coil conductor layer 34*a* of the electronic component 10 except being disposed on the upper principal surface of the insulator layer 26*fa*. A lead-out part 52*a* of the electronic component 10*a* is the same as the lead-out part 52 of the electronic component 10 except that the connecting conductor 70*c* is disposed over the insulator layers 26*ba* to 26*ba* and that the lead-out conductor layer 44*a* is disposed on the upper principal surface of the insulator layer 26*fa*.

The tertiary coil conductor layer 34*b* is disposed on the upper principal surface of the insulator layer 26*ca* and forms a spiral shape spiraling clockwise from the inner circumferential side to the outer circumferential side when viewed from the upper side. In this embodiment, the tertiary coil conductor layer 34*a* has a length of about four turns. The center of the tertiary coil conductor layer 34*b* is substantially coincident with the center (intersection of diagonals) of the electronic component 10 when viewed from the upper side.

In the electronic component 10*a*, the coil conductor layers 30*a*, 32*a*, 34*a*, 30*b*, 32*b*, 34*b*, 36*a* overlap with each other as shown in FIG. 8A when viewed in the lamination direction. Particularly, the inner magnetic path of the primary coil L1*a*, the inner magnetic path of the secondary coil L2*a*, and the inner magnetic path of the tertiary coil L3*a* overlap when viewed in the lamination direction. As a result, the primary coil L1*a*, the secondary coil L2*a*, and the tertiary coil L3*a* are magnetically coupled. To prevent the lead-out parts 50*a*, 53*a*, the lead-out parts 51*a*, 54*a*, and the lead-out parts 52*a*, 55*a* from interfering with each other, the positions of both ends of the coil conductor layers 30*a*, 32*a*, 34*a* are different from each other, and the positions of both ends of the coil conductor layers 30*b*, 36*a*, 34*b* are different from each other, when viewed in the lamination direction. For example, the outer circumferential end portion of the secondary coil conductor layer 32*b* is located downstream in the clockwise direction as compared to the outer circumferential end portions of the primary coil conductor layers 30*b*, 36*a*. The outer circumferential end portion of the tertiary coil conductor layer 34*b* is located downstream in the clockwise direction as compared to the outer circumferential end portion of the secondary coil conductor layer 32*b*. Similarly, the inner circumferential end portion of the secondary coil conductor layer 32*b* is located downstream in the clockwise direction as compared to the inner circumferential end portions of the primary coil conductor layers 30*b*, 36*a*. The inner circumferential end portion of the tertiary coil conductor layer 34*b* is located downstream in the clockwise direction as compared to the inner circumferential end portion of the secondary coil conductor layer 32*b*. This makes the lengths of the coil conductor layers 30*b*, 36*a*, 32*b*, 34*b* substantially the same.

The interlayer connecting conductor v13 is a conductor penetrating the insulator layers 26*ca* to 26*fa* in the up-down direction and forms a linear shape extending in the left-right direction when viewed from the upper side. The interlayer connecting conductor v13 is disposed in the front half regions of the insulator layers 26*ca* to 26*fa* when viewed from the upper side and connects the inner circumferential end portion of the tertiary coil conductor layer 34*a* and the inner circumferential end portion of the tertiary coil conductor layer 34*b*.

The lead-out part 55*a* connects the other end of the tertiary coil L3*a* (the outer circumferential end portion of the tertiary coil conductor layer 34*b*) and the external electrode 14*f*. The lead-out part 55*a* includes a lead-out conductor layer 44*b* and the connecting conductor 70*f*. The connecting conductor 70*f* is a triangular prism-shaped conductor disposed in the corner located at the right front of the insulator layers 26*ba* to 26*ha*. The connecting conductor 70*f* extends in the up-down direction from the upper principal surface of the insulator layer 26*ba* to the lower principal surface of the insulator layer 26*ha* and is connected at the lower end thereof to the connecting part 16*f*.

The lead-out conductor layer 44*b* is disposed on the upper principal surface of the insulator layer 26*ca* and is connected to the outer circumferential end portion of the tertiary coil conductor layer 34*b* and connected to the connecting conductor 70*f*. The lead-out conductor layer 44*b* does not form a spiral shape when viewed from the upper side, and extends from the outer circumferential end portion of the tertiary coil conductor layer 34*b* toward the front side. As a result, the other end of the tertiary coil L3*a* (the outer circumferential end portion of the tertiary coil conductor layer 34*b*) and the external electrode 14*f* are electrically connected through the lead-out part 55*a* (the lead-out conductor layer 44*b* and the connecting conductor 70*f*) and the connecting part 16*f*.

The primary coil conductor layer 36*a* is disposed on the upper side with respect to the tertiary coil conductor layer 34*b* disposed on the uppermost side among the coil conductor layers 30*a*, 32*a*, 34*a*, 30*b*, 32*b*, 34*b*.

As shown in FIG. 8A, the electronic component 10*a* includes a main body (the magnetic material substrates 20*a*, 20*b*, the laminated body 22*a*, and the magnetic material layer 24) including a plurality of the insulator layers 26*aa* to 26*ha* laminated in the up-down direction (lamination direction). Specifically, in the electronic component 10*a*, the plurality of the insulator layers 26*aa* to 26*fa* includes three types of insulator layers, i.e., the insulator layers 26*da*, 26*ga* (an example of the first insulator layer) including portions interposed between the primary coil conductor layers 30*a*, 30*b* and the secondary coil conductor layers 32*a*, 32*b*; the insulator layers 26*ca*, 26*fa* (an example of the second insulator layer) including portions interposed between the secondary coil conductor layers 32*a*, 32*b* and the tertiary coil conductor layers 34*a*, 34*b*; and the insulator layers 26*ba*, 26*ea* (an example of the third insulator layer) including portions interposed between the tertiary coil conductor layers 34*a*, 34*b* and the primary coil conductor layers 36*b*, 36*a*.

The electronic component 10*a* has an insulator layer different in permittivity from the other two types of the insulator layers among the three types of insulator layers, i.e., the insulator layers 26*ba*, 26*ea*, the insulator layers 26*ca*, 26*fa*, and the insulator layers 26*da*, 26*ga*. Therefore, in the electronic component 10*a*, the differential impedance between the coils L1*a* to L3*a* can be adjusted as is the case with the electronic component 10.

As shown in FIG. 8B, the line widths of the coil conductor layers 30*a*, 32*a*, 34*a*, 30*b*, 32*b*, 34*b*, 36*a* are w1 and are the same as each other. However, the thickness of the coil conductor layers 30*a*, 32*a*, 34*a*, 32*b*, 34*b* is d1, and the thickness of the primary coil conductor layers 30*b*, 36*a* is d2. This d2 is a half of d1. Therefore, the sum of the cross-sectional areas of the primary coil conductor layer 30*b* and the primary coil conductor layer 36*a* is substantially the same as the cross-sectional area of the primary coil conductor layer 30*a*, the cross sectional areas of the secondary coil conductor layers 32*a*, 32*b*, and the cross sectional areas of the tertiary coil conductor layers 34*a*, 34*b*.

The insulator layer 26*aa*, 26*ca* to 26*ba* are uniform in thickness. Therefore, the interval D1 is uniform between those adjacent to each other in the up-down direction among the coil conductor layers 30*a*, 32*a*, 34*a*, 30*b*, 32*b*, 34*b*. However, the thickness of the insulator layer 26*ba* is larger than the thickness of the insulator layer 26*aa*, 26*ca* to 26*ha*. Therefore, an interval D3 between the primary coil conductor layer 36*a* and the tertiary coil conductor layer 34*b* is larger than the interval D1.

Even in the electronic component 10*a* having the same configuration as the electronic component 10 as described above, the same effects as the electronic component 10 can be produced.

Additionally, in the electronic component 10*a*, each of the coils L1*a* to L3*a* has a plurality of the coil conductor layers 30*a* to 36*a*, so that a high inductance value can be acquired.

Furthermore, although the electronic component 10*a* has the coil conductor layers 30*a*, 32*a*, 34*a*, 30*b*, 32*b*, 34*b*, 36*a* forming a spiral shape, since each of the coils L1*a* to L3*a* has two (an even number of) coil conductor layers electrically connected in series, it is not necessary to include a lead-out conductor layer connecting an inner circumferential end of the spiral shape of a coil conductor layer and an external electrode, such as the lead-out conductor layers 60, 62, 64 of the electronic component 10.

Although the electronic component 10*a* has two coil conductor layer groups Ga, Gb, an electronic component according to an embodiment of the present disclosure may have three or more coil conductor layer groups. The case of an electronic component having n (n is a natural number) coil conductor layer groups Ga, Gb . . . will hereinafter be described.

If the electronic component has n coil conductor layer groups, the primary coil includes n series primary coil conductor layers and one parallel primary coil conductor layer, the secondary coil includes n secondary coil conductor layers, and the tertiary coil includes n coil conductor layers. Additionally, n coil conductor layer groups Ga are arranged side by side from the lower side to the upper side, each having the series primary coil conductor layer, the secondary coil conductor layer, and the tertiary coil conductor layer arranged one by one in this order from the lower side to the upper side.

In this case, the parallel primary coil conductor layer forms the same shape as a predetermined series primary coil conductor layer of the n series primary coil conductor layers, and is electrically connected in parallel to the predetermined serial primary coil conductor layer. Furthermore, the parallel primary coil conductor layer is disposed on the upper side with respect to a predetermined tertiary coil conductor layer disposed on the uppermost side.

In this case, when the coil conductor layers form a spiral shape, setting n to an even number can eliminate the need for a lead-out conductor layer connecting an inner circumferential end of the spiral shape of a coil conductor layer and an external electrode in each coil as is the case with the electronic component 10*a*.

Third Modification Example

Figure 9:
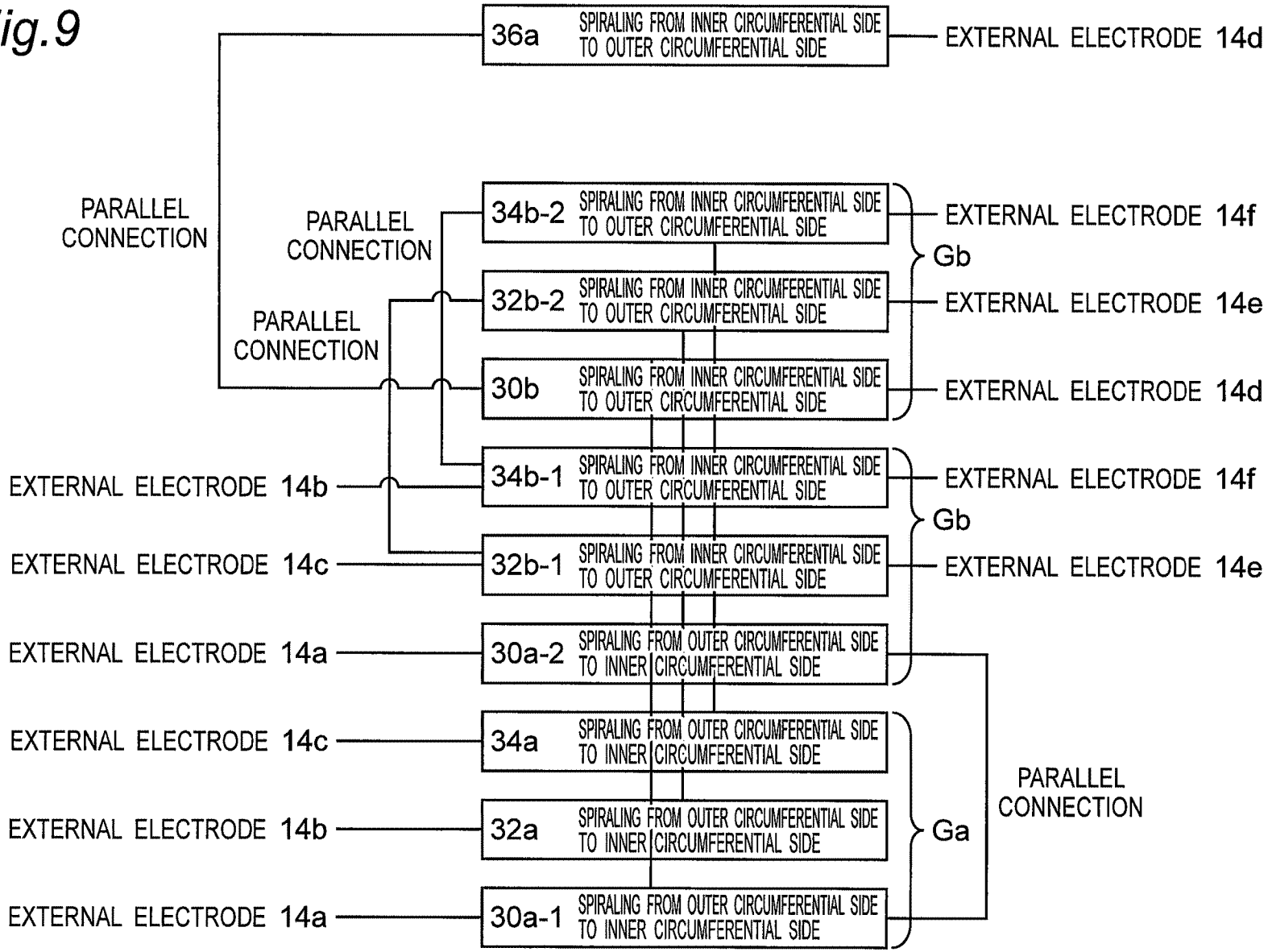
FIG. 9 is a schematic view of a positional relationship of coil conductor layers 30*a*-1, 30*a*-2, 32*a*, 34*a*, 30*b*, 32*b*-1, 32*b*-2, 34*b*-1, 34*b*-2, 36*a* of an electronic component 10*b*.

A configuration of an electronic component 10*b* according to a third modification example will hereinafter be described with reference to the drawings. FIG. 9 is a schematic of a positional relationship of coil conductor layers 30*a*-1, 30*a*-2, 32*a*, 34*a*, 30*b*, 32*b*-1, 32*b*-2, 34*b*-1, 34*b*-2, 36*a* of the electronic component 10*b*.

In the electronic component 10*a*, as shown in FIG. 7B, the primary coil conductor layer 30*b* and the primary coil conductor layer 36*a* are electrically connected in parallel. On the other hand, as shown in FIG. 9, the electronic component 10*b* has four pairs, i.e., the primary coil conductor layer 30*a*-1 and the primary coil conductor layer 30*a*-2, the secondary coil conductor layer 32*b*-1 and the secondary coil conductor layer 32*b*-2, the tertiary coil conductor layer 34*b*-1 and the tertiary coil conductor layer 34*b*-2, and the primary coil conductor layer 30*b* and the primary coil conductor layer 36*a*, each electrically connected in parallel. The electronic component according to an embodiment of the present disclosure may have the coil conductor layers connected in parallel at a plurality of locations in this way. In the electronic component 10*b*, for example, the primary coil conductor layer 30*a*-1 (or the primary coil conductor layer 30*a*-2) corresponds to the other series primary coil conductor layers; the primary coil conductor layer 30*b* corresponds to the predetermined series primary coil conductor layer; the primary coil conductor layer 36*a* corresponds to the parallel primary coil conductor layer; and the tertiary coil conductor layer 34*b*-2 corresponds to the predetermined tertiary coil conductor layer.

In this case, although not shown, the electronic component 10*b* comprises a main body including a plurality of insulator layers laminated in the up-down direction (lamination direction), and the plurality of insulator layers includes three types of insulator layers, i.e., the insulator layers (an example of the first insulator layer) including portions interposed between the primary coil conductor layers 30*a*-1, 30*a*-2, 30*b* and the secondary coil conductor layers 32*a*, 32*b*-1, 32*b*-2; the insulator layers (an example of the second insulator layer) including portions interposed between the secondary coil conductor layers 32*a*, 32*b*-1, 32*b*-2 and the tertiary coil conductor layers 34*a*, 34*b*-1, 34*b*-2; and the insulator layers (an example of the third insulator layer) including portions interposed between the tertiary coil conductor layers 34*a*, 34*b*-1, 34*b*-2 and the primary coil conductor layers 30*a*-2, 36*b*, 36*a*.

The electronic component 10*b* has an insulator layer different in permittivity from the other two types of the insulator layers among the three types of insulator layers described above. Therefore, in the electronic component 10*b*, the differential impedance between the coils can be adjusted as is the case with the electronic component 10.

Fourth Modification Example

Figure 10:
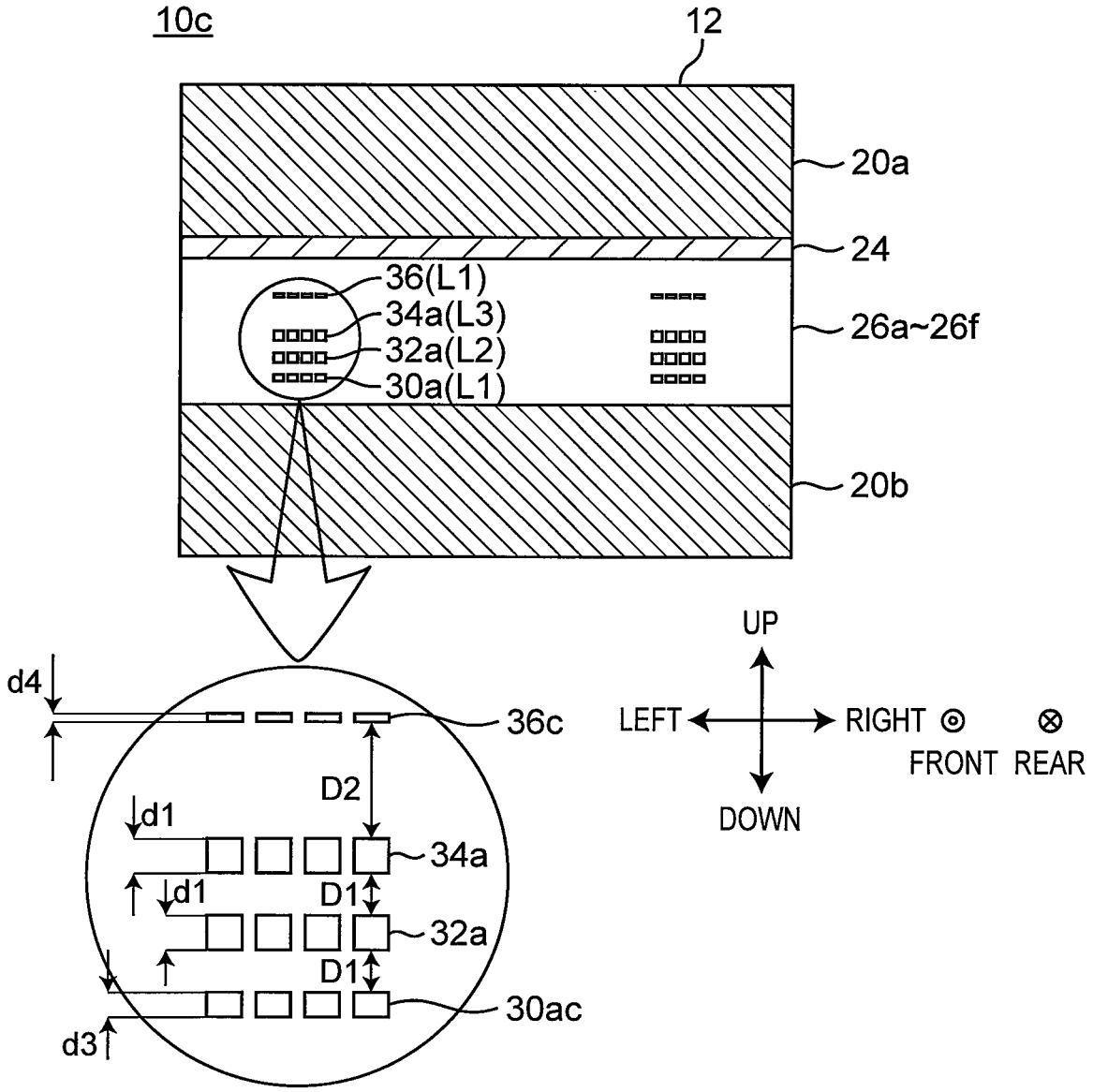
FIG. 10 is a schematic sectional view of an electronic component 10*c*.

A configuration of an electronic component 10*c* according to a fourth modified example will hereinafter be described with reference to the drawings. FIG. 10 is a schematic cross-sectional view of the electronic component 10*c*. The cross section of FIG. 10 corresponds to the cross section of FIG. 3. The exterior appearance of the electronic component 10*c* is the same as the electronic component 10.

The electronic component 10*c* is different from the electronic component 10 in the thickness of the primary coil conductor layers 30*ac*, 36*c*. More specifically, in the electronic component 10, as shown in FIG. 3B, the primary coil conductor layers 30*a*, 36 have the same thickness d2.

On the other hand, in the electronic component 10*c*, as shown in FIG. 10, the primary coil conductor layer 30*ac* having a thickness d3 and the primary coil conductor layer

36*c* having a thickness d4 are different in thickness. For example, d4 is about ⅓ of d3, and the sum of d3 and d4 is substantially the same as d1. Since the coil conductor layers 30*ac*, 36*c* have the same line width w1 as the coil conductor layers 32*a*, 34*a*, the sum of the cross sectional areas of the primary coil conductor layer 30*ac* and the primary coil conductor layer 36*c* is substantially the same as the cross sectional area of the secondary coil conductor layer 32*a* and the cross sectional area of the tertiary coil conductor layer 34*a*.

Even in the electronic component 10*c* as described above, the same effects as the electronic component 10 can be produced.

In the electronic component 10*c*, the thickness d4 may be larger than the thickness d3.

Fifth Modification Example

Figure 11:
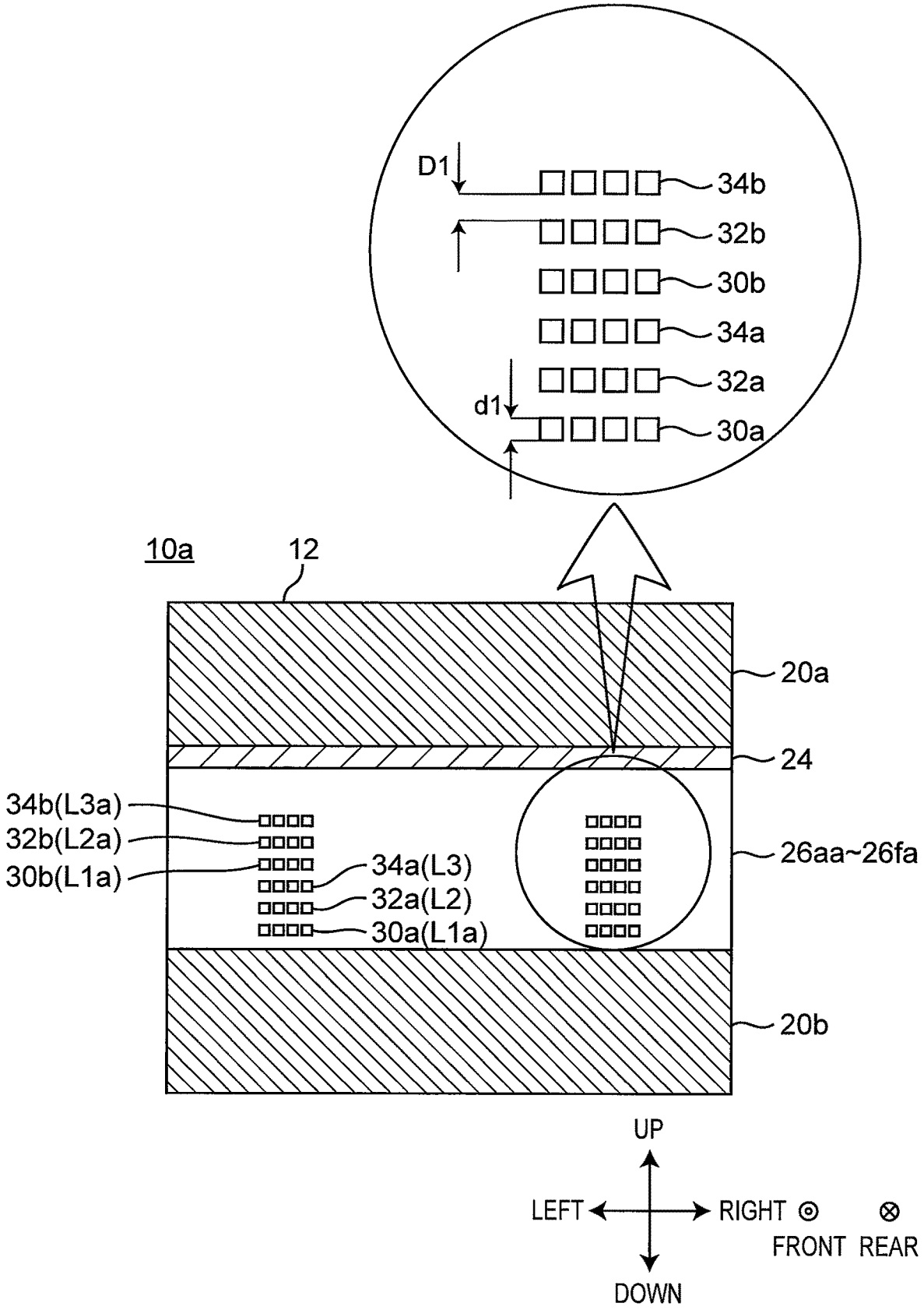
FIG. 11 is a schematic cross-sectional view of an electronic component 10*d*.
Figure 12:
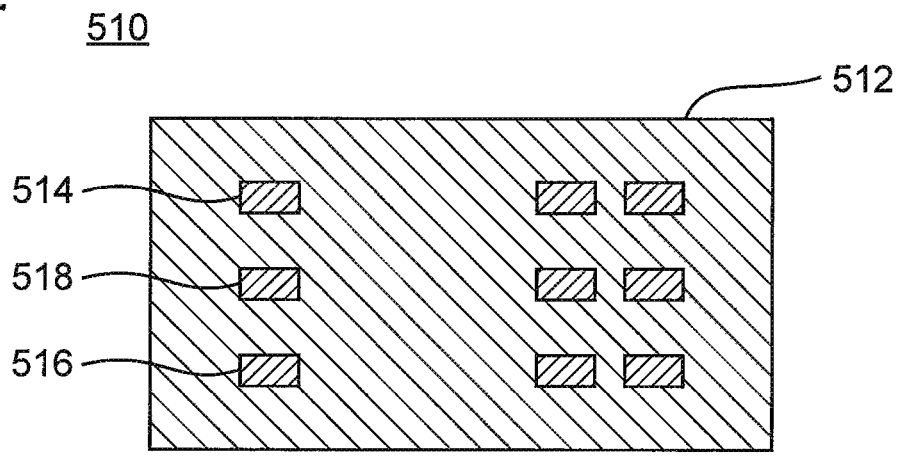
FIG. 12 is a cross-sectional structural view of a common mode choke coil 510 described in Japanese Patent No. 4209851.

A configuration of an electronic component 10*d* according to a fifth modified example will hereinafter be described with reference to the drawings. FIG. 11 is a schematic cross-sectional view of the electronic component 10*d*. The exterior appearance of the electronic component 10*d* is the same as the electronic component 10.

The electronic component 10*d* has the same configuration as the electronic component 10*a* except being different from the electronic component 10*a* in that the primary coil conductor layer 36*a* is not disposed.

Although the primary coil conductor layer 36*a* is not disposed, the electronic component 10*d* includes a main body including a plurality of insulator layers laminated in the up-down direction (lamination direction), and the plurality of insulator layers includes three types of insulator layers, i.e., the insulator layer (an example of the first insulator layer) including a portion interposed between the primary coil conductor layers 30*a*, 30*b* and the secondary coil conductor layers 32*a*, 32*b*; the insulator layer (an example of the second insulator layer) including a portion interposed between the secondary coil conductor layers 32*a*, 32*b* and the tertiary coil conductor layer 34*a*, 34*b*; and the insulator layer (an example of the third insulator layer) including a portion interposed between the tertiary coil conductor layer 34*a* and the primary coil conductor layer 30*b*.

The electronic component 10*d* has an insulator layer different in permittivity from the other two types of the insulator layers among the three types of insulator layers described above. Therefore, in the electronic component 10*d*, the differential impedance between the coils can be adjusted as is the case with the electronic component 10.

As described above, in the electronic component according to an embodiment of the present disclosure, the parallel primary coil conductor layer is not essential, and it is not essential to adjust the differential impedance through the interval between the coil conductor layers. However, when the primary coil conductor layer includes the parallel primary coil conductor layer and the third insulator layer includes a fourth insulator layer (such as the insulator layers 26*b*, 26*c* of the electronic component 10) interposed between the tertiary coil conductor layer and the parallel primary coil conductor layer as is the case with the electronic component 10, the differential impedances between the coils can be brought closer to each other and can further be adjusted.

Other Embodiments

The electronic component according to an embodiment of the present disclosure is not limited to the electronic components 10, 10*a* to 10*d* and can be changed within the scope of the spirit thereof and, for example, the configurations included in the electronic components 10, 10*a* to 10*d* may arbitrarily be combined.

In the electronic components according to the embodiments, the thickness of the coil conductor layers is not uniform; however, this is not a limitation to the thickness of the coil conductor layers. For example, the thickness of the coil conductor layers may substantially be the same (uniform) as each other.

Although the electronic component 10 is fabricated by a photolithography method, the electronic component 10 may be produced by a lamination method in which insulator layers such as green sheets having coil conductor layers printed thereon are laminated and then fired. The method of forming coil conductor layers may not only be the subtractive method and the printing method described above but also may be a full-additive method or a semi-additive method.

In the description of the embodiments described above, the adjustment is made for reducing a difference in differential impedance between the coils by using the permittivity of the first insulator layer, the second insulator layer, and the third insulator layer; however, the permittivity may be adjusted to increase a difference in differential impedance between the coils. For some circuit boards, an electronic component with such a large difference in differential impedance may be preferable.

In the description of examples of the embodiments, the parallel primary coil conductor layer connected in parallel and the predetermined series primary coil conductor layer have the same shape when viewed in the lamination direction; however, the electronic component according to an embodiment of the present disclosure is not limited to this configuration, and the parallel primary coil conductor layer and the predetermined series primary coil conductor layer may not form the same shape. In the electronic component according to an embodiment of the present disclosure, the primary coil, the secondary coil, and the tertiary coil may not necessarily be the same in terms of the shape (the length of the current path, the cross-sectional area, the number of turns, the inner diameter, the outer diameter) and the material.

In the embodiments, the coil conductor layers form a spiral (two-dimensionally swirling) shape. However, in the electronic component according to an embodiment of the present disclosure, the coil conductor layer may have a helical (three-dimensionally swirling) shape.

The invention claimed is:

1. An electronic component comprising:

a main body including a plurality of insulator layers laminated in a lamination direction;

a primary coil disposed in the main body and including a plurality of primary coil conductor layers;

a secondary coil disposed in the main body and including one or more secondary coil conductor layers; and a tertiary coil disposed in the main body and including one or more tertiary coil conductor layers, wherein the plurality of insulator layers includes a first insulator layer including a portion interposed between one of the primary coil conductor layers and one secondary coil conductor layer of the one or more secondary coil conductor layers, a second insulator layer including a portion interposed between the one secondary coil conductor layer and one tertiary coil conductor layer of the one or more tertiary coil conductor layers, and a third insulator layer including a portion interposed between the one tertiary coil conductor layer and another of the primary coil conductor layers, wherein the electronic component has an insulator layer different in permittivity from the other insulator layers among the first insulator layer, the second insulator layer, and the third insulator layer, and wherein the permittivity of the third insulator layer is different from the permittivity of the first insulator layer and the permittivity of the second insulator layer.

2. The electronic component according to claim 1, further comprising a first external electrode electrically connected to one end of the primary coil, a second external electrode electrically connected to one end of the secondary coil, and a third external electrode electrically connected to one end of the tertiary coil, wherein the first external electrode, the second external electrode, and the third external electrode are arranged in this order along a predetermined direction orthogonal to the lamination direction on one surface of the main body.

3. The electronic component according to claim 2, further comprising a fourth external electrode electrically connected to the other end of the primary coil, a fifth external electrode electrically connected to the other end of the secondary coil, and a sixth external electrode electrically connected to the other end of the tertiary coil, wherein the fourth external electrode, the fifth external electrode, and the sixth external electrode are arranged in this order along the predetermined direction on one surface of the main body, and wherein the primary coil, the secondary coil, and the tertiary coil all have the same circumferential direction from the first external electrode to the fourth external electrode, from the second external electrode to the fifth external electrode, and from the third external electrode to the sixth external electrode, respectively.

4. An electronic component comprising:

a main body including a plurality of insulator layers laminated in a lamination direction;

a primary coil disposed in the main body and including a plurality of primary coil conductor layers;

a secondary coil disposed in the main body and including one or more secondary coil conductor layers; and a tertiary coil disposed in the main body and including one or more tertiary coil conductor layers, wherein the plurality of insulator layers includes a first insulator layer including a portion interposed between one of the primary coil conductor layers and one secondary coil conductor layer of the one or more secondary coil conductor layers, a second insulator layer including a portion interposed between the one secondary coil conductor layer and one tertiary coil conductor layer of the one or more tertiary coil conductor layers, and a third insulator layer including a portion interposed between the one tertiary coil conductor layer and another of the primary coil conductor layers, wherein the electronic component has an insulator layer different in permittivity from the other insulator layers among the first insulator layer, the second insulator layer, and the third insulator layer, the plurality of primary coil conductor layers include a natural number n of series primary coil conductor layers and one parallel primary coil conductor layer, wherein the one or more secondary coil conductor layers include n secondary coil conductor layers, wherein the one or more tertiary coil conductor layers include n tertiary coil conductor layers, wherein the parallel primary coil conductor layer is electrically connected in parallel to a predetermined series primary coil conductor layer of the n series primary coil conductor layers, and wherein the third insulator layer includes a fourth insulator layer including a portion interposed between the tertiary coil conductor layer and the parallel primary coil conductor layer.

5. The electronic component according to claim 4, wherein the electronic component has n coil conductor layer groups arranged from one side to the other side in the lamination direction, wherein the coil conductor layer groups each have the series primary coil conductor layer, the secondary coil conductor layer, and the tertiary coil conductor layer arranged one by one in this order from one side to the other side in the lamination direction, and wherein the parallel primary coil conductor layer is disposed on the other side in the laminated direction with respect to the predetermined tertiary coil conductor layer disposed on the farthest other side in the lamination direction.

6. The electronic component according to claim 5, wherein an interval between the parallel primary coil conductor layer and the predetermined tertiary coil conductor layer in the lamination direction is larger than intervals between the coil conductor layers adjacent to each other in the lamination direction in the n coil conductor layer groups.

7. The electronic component according to claim 5, wherein the coil conductor layers adjacent to each other in the lamination direction have uniform intervals in the n coil conductor layer groups.

8. The electronic component according to claim 4, wherein the parallel primary coil conductor layer and the predetermined series primary coil conductor layer have the same shape when viewed in the lamination direction.

9. The electronic component according to claim 8, wherein the primary coil, the secondary coil, and the tertiary coil have lengths of current paths identical to each other, wherein when the (n-1) series primary coil conductor layers other than the predetermined series primary coil conductor layer are defined as the other series primary coil conductor layers, the other series primary coil conductor layers all have the same cross-sectional area, and wherein a sum of a cross-sectional area of the predetermined series primary coil conductor layer and a cross-sectional area of the parallel primary coil conductor layer are the same as a cross-sectional area of the other series primary coil conductor layers.

10. The electronic component according to claim 8, wherein the cross- sectional area of the predetermined series primary coil conductor layer and the cross-sectional area of the parallel primary coil conductor layer are the same.

11. The electronic component according to claim 8, wherein the n secondary coil conductor layers and the n tertiary coil conductor layers all have a same cross-sectional area, and wherein the sum of the cross-sectional area of the predetermined series primary coil conductor layer and the cross-sectional area of the parallel primary coil conductor layer is the same as the cross-sectional area of the secondary coil conductor layer and the cross-sectional area of the tertiary coil conductor layer.

12. The electronic component according to claim 8, wherein a volume of conductor constituting the primary coil, a volume of conductor constituting the secondary coil, and a volume of conductor constituting the tertiary coil are the same as each other.

* * * * *